US011033156B2

(12) United States Patent
Wallenius et al.

(10) Patent No.: US 11,033,156 B2
(45) **Date of Patent: *Jun. 15, 2021**

(54) PACKAGE COMPRISING A STACK OF ABSORBENT TISSUE PAPER MATERIAL AND A PACKAGING

(71) Applicant: ESSITY HYGIENE AND HEALTH AKTIEBOLAG, Gothenburg (SE)

(72) Inventors: Hans Wallenius, Gothenburg (SE); Fredrik Welander, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

This patent is subject to a terminal disclaimer.

(21) Appl. No.: 16/804,869

(22) Filed: Feb. 28, 2020

(65) Prior Publication Data

US 2020/0196806 A1 Jun. 25, 2020

Related U.S. Application Data

(63) Continuation of application No. 15/579,829, filed as application No. PCT/SE2015/050722 on Jun. 22, 2015, now Pat. No. 10,602,886.

(51) Int. Cl.
*A47K 10/16* (2006.01)
*B65B 25/14* (2006.01)
(Continued)

(52) U.S. Cl.
CPC ..... *A47K 10/16* (2013.01); *A47K 10/20* (2013.01); *B65B 25/14* (2013.01); *B65B 63/02* (2013.01); *B65B 63/026* (2013.01); *B65D 85/07* (2018.01)

(58) Field of Classification Search
CPC ..... A47K 10/16
(Continued)

(56) References Cited

U.S. PATENT DOCUMENTS 3,172,563 A 3/1965 Harwood
3,513,628 A 5/1970 Lee et al.
(Continued)

FOREIGN PATENT DOCUMENTS

CN 1352547 A 6/2002
CN 101171173 A 4/2008
(Continued)

OTHER PUBLICATIONS

Office Action issued by the Ministry of Economic Development and Trade of Ukraine dated Apr. 22, 2020 in Ukrainian Patent Application No. a2017 10588, 7 pages, with English Translation.
(Continued)

*Primary Examiner* — Brent T O'Hern
(74) *Attorney, Agent, or Firm* — Buchanan Ingersoll & Rooney P.C.

(57) ABSTRACT

A package including a stack of absorbent tissue paper material and a packaging, wherein, in the stack, the tissue material forms panels having a length, and a width perpendicular to the length, the panels being piled on top of each other to form a height extending between a first end surface and a second end surface of the stack; the absorbent tissue paper material including at least a dry crepe material, the stack, when in the package, having a selected packing density D0 of 0.25 to 0.65 kg/dm$^3$, and exerting a force along the height of the stack towards the packaging, the packaging encircling the stack so as to maintain the stack in a compressed condition with the selected packing density D0.

19 Claims, 11 Drawing Sheets

(51) Int. Cl.

| | |
|---|---|
| ***B65B 63/02*** | (2006.01) |
| ***B65D 85/07*** | (2017.01) |
| ***A47K 10/20*** | (2006.01) |

(58) Field of Classification Search
USPC ..... 428/43
See application file for complete search history.

(56) References Cited

U.S. PATENT DOCUMENTS

| | | | | |
|---|---|---|---|---|
| 3,710,536 | A | 1/1973 | Lee et al. | |
| 3,908,539 | A | 9/1975 | O'Brien | |
| 4,408,438 | A | 10/1983 | Rewitzer | |
| 4,934,535 | A | 6/1990 | Muckenfuhs et al. | |
| 5,406,774 | A | 4/1995 | Dodge | |
| 5,459,979 | A | 10/1995 | Tommasi | |
| 5,535,887 | A | 7/1996 | Young et al. | |
| 5,853,547 | A | 12/1998 | Ahrens et al. | |
| 6,321,511 | B1 | 11/2001 | O'Connor et al. | |
| 6,423,180 | B1 | 7/2002 | Behnke et al. | |
| 6,510,945 | B1 | 1/2003 | Allwein et al. | |
| 7,527,709 | B2 | 5/2009 | Lippi et al. | |
| 7,550,061 | B2 | 6/2009 | Walkenhaus et al. | |
| 7,744,726 | B2 | 6/2010 | Scherb et al. | |
| 8,205,748 | B2 | 6/2012 | Long et al. | |
| 8,389,092 | B2 | 3/2013 | Andersson | |
| 10,602,886 | B2 * | 3/2020 | Wallenius | B65B 63/02 |
| 2002/0117419 | A1 | 8/2002 | Tippey et al. | |
| 2002/0134520 | A1 | 9/2002 | Behnke et al. | |
| 2003/0183550 | A1 | 10/2003 | Diliberto, Jr. | |
| 2006/0249406 | A1 | 11/2006 | Sanderson et al. | |
| 2007/0271872 | A1 | 11/2007 | De | |
| 2007/0277479 | A1 | 12/2007 | Hansen et al. | |
| 2010/0243504 | A1 | 9/2010 | Long et al. | |
| 2013/0269893 | A1 * | 10/2013 | Nelvig | B65B 63/02 162/111 |
| 2014/0137515 | A1 | 5/2014 | Brandhorst et al. | |
| 2015/0078876 | A1 | 3/2015 | Michler et al. | |
| 2018/0155102 | A1 * | 6/2018 | Wallenius | B65D 85/07 |
| 2018/0160867 | A1 | 6/2018 | Wallenius et al. | |
| 2018/0354667 | A1 | 12/2018 | Wallenius et al. | |

FOREIGN PATENT DOCUMENTS

| | | | |
|---|---|---|---|
| CN | 102249014 | A | 11/2011 |
| CN | 102369144 | A | 3/2012 |
| CN | 103748014 | A | 4/2014 |
| EP | 0828671 | B1 | 11/2001 |
| EP | 1156925 | A1 | 11/2001 |
| EP | 2150472 | A1 | 2/2010 |
| FR | 2901257 | A1 | 11/2007 |
| JP | H11506072 | A | 6/1999 |
| MX | 2011008883 | A | 9/2011 |
| MX | 2013014362 | A | 1/2014 |
| RU | 2 575 305 | C2 | 1/2015 |
| SU | 825370 | A1 | 4/1981 |
| SU | 996277 | A1 | 2/1983 |
| WO | 9638353 | A1 | 12/1996 |
| WO | 0040405 | A1 | 7/2000 |
| WO | 0072819 | A1 | 12/2000 |
| WO | 2008146010 | A1 | 12/2008 |
| WO | 2010104430 | A1 | 9/2010 |
| WO | 2012087211 | A1 | 6/2012 |
| WO | 2012173534 | A1 | 12/2012 |
| WO | 2014098665 | A1 | 6/2014 |
| WO | 2014098667 | A1 | 6/2014 |

OTHER PUBLICATIONS

International Search Report (PCT/ISA/210) dated Mar. 1, 2016, by the Swedish Patent Office as the International Searching Authority for International Application No. PCT/SE2015/050722.

Written Opinion (PCT/ISA/237) dated Mar. 1, 2016, by the Swedish Patent Office as the International Searching Authority for International Application No. PCT/SE2015/050722.

International Search Report (PCT/ISA/210) dated Mar. 7, 2016, by the Swedish Patent Office as the International Searching Authority for International Application No. PCT/SE2015/050721.

Written Opinion (PCT/ISA/237) dated Mar. 7, 2016, by the Swedish Patent Office as the International Searching Authority for International Application No. PCT/SE2015/050721.

International Search Report (PCT/ISA/210) dated Mar. 7, 2016, by the Swedish Patent and Registration Office as the International Searching Authority for International Application No. PCT/SE2015/050723.

Written Opinion (PCT/ISA/237) dated Mar. 7, 2016, by the Swedish Patent and Registration Office as the International Searching Authority for International Application No. PCT/SE2015/050723.

Office Action 511 dated Nov. 30, 2017, by the Colombian Patent Office in Colombian Patent Application No. NC2017/0012388 and an English Translation of the Office Action. (10 pages).

Office Action dated Apr. 26, 2018, by the Australian Government/IP Australia in corresponding Australian Patent Application No. 2015399432. (3 pages).

Office Action dated May 2, 2018, by the Australian Government/IP Australia in Australian Patent Application No. 22015399433. (3 pages).

Office Action dated Apr. 30, 2018, by the Australian Government/IP Australia in Australian Patent Application No. 2015399431. (3 pages).

Office Action (Search Report) dated Jun. 20, 2018, by the Federal State-financed Institution "Federal Institute of Industrial Property" in Russian Patent Application No. 2017134627/13(060845) and an English Translation of the Office Action (Search Report). (11 pages).

Office Action (Decision to Grant) dated Aug. 16, 2018, by the Federal Service for Intellectual Property in Russian Patent Application No. 2017135411/13 (061777) and an English Translation of the Office Action. (19 pages).

Office Action dated Aug. 30, 2018, by the Colombian Patent Office in Colombian Patent Application No. SD2017/0012392 and partial English Translation of the Office Action. (16 pages).

Office Action dated Aug. 30, 2018, by the Colombian Patent Office in Colombian Patent Application No. NC2017/0012388 and partial English Translation of the Office Action. (18 pages).

Office Action dated Aug. 21, 2018, by the Canadian Intellectual Property Office in Canadian Patent Application No. 2,981,245 (5 pages).

Office Action dated Aug. 23, 2018, by the Canadian Intellectual Property Office in Canadian Patent Application No. 2,981,240 (5 pages).

Office Action dated Aug. 23, 2018, by the Canadian Intellectual Property Office in Canadian Patent Application No. 2,981,249 (6 pages).

Extended European Search Report dated Oct. 11, 2018, issued by the European Patent Office in corresponding European Application No. 15896477.5-1016, (7 pages).

Extended European Search Report dated Oct. 11, 2018, issued by the European Patent Office in corresponding European Application No. 15896479.1-1016, (8 pages).

Extended European Search Report dated Oct. 11, 2018, issued by the European Patent Office in corresponding European Application No. 15896478.3-1016, (7 pages).

Office Action dated Nov. 12, 2018, by the Chilean Patent Office in corresponding Chilean Patent Application No. 201703114, (11 pages).

Office Action (Decision to Grant) dated Nov. 16, 2018, by the Federal Service for Intellectual Property in Russian Patent Application No. 2017134627/10(060845) and an English Translation of the Office Action. (16 pages).

Office Action (Decision to Grant) dated Nov. 16, 2018, by the Federal Service for Intellectual Property in Russian Patent Application No. 2017134623/10(060840) and an English Translation of the Office Action. (16 pages).

(56) References Cited

OTHER PUBLICATIONS

Office Action issued by the U.S. Patent and Trademark Office in the U.S. Appl. No. 15/579,810, dated Jan. 11, 2019, U.S. Patent and Trademark Office, Alexandria, VA. (10 pages).
Office Action No. 801 dated Mar. 11, 2019, by the Colombian Patent Office in Colombian Patent Application No. NC2017/0012291 and an English Translation of the Office Action. (15 pages).
Office Action (Notification of the First Office Action) dated Jan. 30, 2019, by the State Intellectual Property Office (SIPO) of the People's Republic of China in Chinese Patent Application No. 201580080571.3, and an English Translation of the Office Action. (16 pages).
Office Action (Notification of the First Office Action) dated Jan. 31, 2019, by the State Intellectual Property Office (SIPO) of the People's Republic of China in Chinese Patent Application No. 201580080565.8, and an English Translation of the Office Action. (17 pages).
Office Action (Notification of the First Office Action) dated Jan. 31, 2019, by the State Intellectual Property Office (SIPO) of the People's Republic of China in Chinese Patent Application No. 201580080564.3, and an English Translation of the Office Action. (18 pages).
Office Action dated May 31, 2019, by the Russian Patent Office in corresponding Russian Patent Application No. 2017 10588, and an English Translation of the Office Action, 6 pages.
Office Action (Communication pursuant to Article 94(3) EPC) dated Jun. 17, 2019, by the European Patent Office in European Application No. 15 896 477.5-1016, 4 pages.
Office Action No. 5458 dated Aug. 1, 2019, by the Colombian Patent Office in Colombian Patent Application No. NC2017/0012392 and an English Translation of the Office Action. (15 pages).
Office Action No. 5156 dated Jul. 22, 2019, by the Colombian Patent Office in Colombian Patent Application No. NC2017/0012388, and an English Translation of the Office Action. (17 pages).
Office Action (Communication pursuant to Article 94(3) EPC) dated Jul. 19, 2019, by the European Patent Office in corresponding European Application No. 15 896 478.3-1016. (3 pages).
Office Action (Notification of the Second Office Action) dated Sep. 17, 2019, by the State Intellectual Property Office (SIPO) of the People's Republic of China in corresponding Chinese Patent Application No. 201580080565.8 and an English Translation of the Office Action. (14 pages).
U.S. Appl. No. 15/579,804, Hans Wallenius, filed Dec. 5, 2017.
U.S. Appl. No. 15/579,810, Hans Wallenius, filed Dec. 5, 2017.
Copending U.S. Appl. No. 15/579,804, filed Dec. 5, 2017.
Copending U.S. Appl. No. 15/579,810, filed Dec. 5, 2017.
Office Action 6296 dated May 29, 2020, by the Colombian Patent Office in Colombian Patent Application No. NC2017/0012388 and an English Translation of the Office Action. (22 pages).
Office Action 6799 dated Jun. 10, 2020, by the Colombian Patent Office in Colombian Patent Application No. NC2017/0012392 and an English Translation of the Office Action. (31 pages).

* cited by examiner

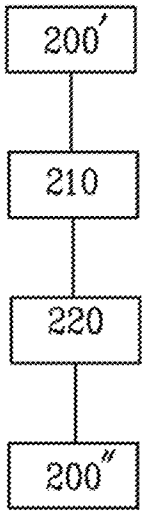
Fig.2a
Fig.2b
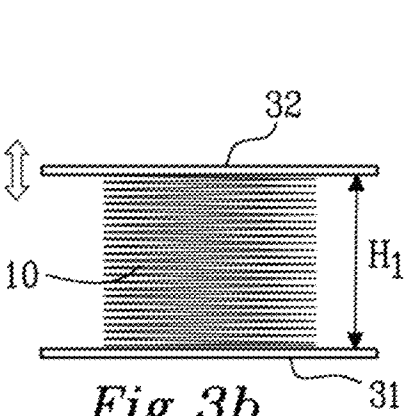
Fig.3a
Fig.3b
Fig.3c

PACKAGE COMPRISING A STACK OF ABSORBENT TISSUE PAPER MATERIAL AND A PACKAGING

CROSS REFERENCE TO RELATED APPLICATIONS

The present application is a continuation of U.S. application Ser. No. 15/579,829, filed on Dec. 5, 2017, now U.S. Pat. No. 10,602,886, which is a U.S. national phase of International Application No. PCT/SE2015/050722, filed on Jun. 22, 2015. The entire contents of each of U.S. application Ser. No. 15/579,829 and International Application No. PCT/SE2015/050722 are hereby incorporated herein by reference in their entirety.

TECHNICAL FIELD

The present disclosure relates to the field of a package comprising a stack of absorbent tissue paper material and a packaging.

BACKGROUND

Stacks of absorbent tissue paper material are used for providing web material to users for wiping and or cleaning purposes. Conventionally, the stacks of tissue paper material are designed for introduction into a dispenser, which facilitates feeding of the tissue paper material to the end user. Also, the stacks provide a convenient form for transportation of the folded tissue paper material. To this end, the stacks are often provided with a packaging, to maintain and protect the stack during transport and storage thereof. Accordingly, packages are provided comprising a stack of tissue paper material, and a corresponding packaging.

During transportation of packages containing tissue paper material, there is a desire to reduce the bulk of the transported material. Typically, the volume of a package including a stack of tissue paper material includes substantial amounts of air between panels and inside the panels of the tissue paper material. Hence, substantial cost savings could be made if the bulk of the package could be reduced, such that greater amounts of tissue paper material may be transported e.g. per pallet or truck.

Also, when filling a dispenser for providing tissue paper material to users there is a desire to reduce the bulk of the stack to be introduced into the dispenser, such that a greater amount of tissue paper material may be introduced in a fixed housing volume in a dispenser. If a greater amount of tissue paper material may be introduced into a dispenser, the dispenser will need refilling less frequently. This provides cost saving opportunities in view of a diminished need for attendance of the dispenser.

In view of the above, attempts have been made to reduce the volume of a stack comprising an amount of tissue paper material, for example by applying pressure to the stack so as to compress the tissue paper material in a direction along the height of the stack.

However, it is known in the art, that when subject to relatively high compacting pressures, the properties of the absorbent tissue paper material may alter, and the perceived quality of the absorbent tissue paper material may be impaired, e.g. the absorbency may be reduced. Also, stacks having been subject to relatively high compacting pressures may suffer from the plies of the stack becoming attached to each other, such that stack resists unfolding and consequently the withdrawal of tissue paper material from the stack is rendered more difficult for a user.

Another problem with packages providing highly compressed stacks in a packaging, is that the compressed stacks will strive to reexpand. Accordingly, the outermost panel surfaces of the stacks will exert a force, which may be referred to as a springback force, on the packaging when inside the package. Moreover, when the packaging is removed, the springback force will cause the stack to reexpand. Accordingly, a stack as provided without its packaging, ready for introduction into a dispenser, may be considerably less compressed as compared to the same stack when within its packaging.

Also, the spring back force may pose problems during the package manufacturing process, in particular when it comes to applying the packaging to the stack to form the complete package. In facilities for mass production of packages, which may produce about 100 packages per minute, it is necessary that all steps in the manufacturing may be performed within a limited amount of time. In this context, it has proven difficult to apply a packaging such that it is able to resist the springback force of a relatively highly compressed stack within the available limited amount of time.

In view of the above, there is a need for an improved package comprising a stack of tissue paper material and a packaging.

SUMMARY

Such a package is obtained by a package comprising a stack of absorbent tissue paper material and a packaging, wherein, in said stack, the tissue material forms panels having a length (L), and a width (W) perpendicular to said length (L), said panels being piled on top of each other to form a height (H) extending between a first end surface and a second end surface of the stack;

- the absorbent tissue paper material comprising at least a dry crepe material,
- the stack, when in said package, having a selected packing density D0 of 0.25 to 0.65 kg/dm$^3$, and exerting a force along the height (H) of said stack towards the packaging, the packaging encircling said stack so as to maintain said stack in a compressed condition with said selected packing density D0.

It has been realized, that the interaction between the stack and the packaging is relevant for the possibility of providing packages comprising a relatively large amount of material, i.e. a stack having a relatively high density as compared to other stacks of the same material. In such packages, the stack may be held in a compressed state by means of the packaging. However, if the packaging is subject to large forces from the stack striving to expand inside the packaging, practical problems associated with the need for easy and reliable procedures for industrial manufacturing of the packages may occur. By studying the state of the stack when inside the packaging, it has been realized that a stack may be provided, which may be more easily provided with a packaging, than prior art stacks. Accordingly, a packaging may be provided which is suitable for industrial manufacturing, and which also presents advantages in that a relatively large amount of material may be provided in the volume of the package.

The packing density D0 is the density of the stack when maintained in a compressed condition in the package. The packing density D0 may be defined as the weight of the stack divided with the packing volume of the stack, the packing volume being the length (L) of the panels×the width (W) of the panels×the packing height H0 of the stack when inside the package. More specific definitions are found in the following method description.

In accordance with the above, a package comprising a stack of folded web material is provided, which is advantageous in that the packing density D0 of the stack is as set out in the above, i.e. the packing density D0 is relatively high, meaning that the stack provides more absorbent tissue paper material within a selected outer volume than many prior art packages of the same kind of material.

It is well-known in the art that a stack of tissue paper material, which has been compressed in the height direction thereof, will strive to re-expand along the height direction. This tendency to reexpand causes a compressed stack to exert a force, sometimes referred to as a "spring back force", on any constraint maintaining it in the compressed condition.

As will be explained herein, the provision of a stack is enabled, wherein the springback force exerted by the compressed stack towards the packaging will be relatively low.

Accordingly, previous problems experienced when applying a packaging to a stack of absorbent tissue paper material with the packing densities proposed herein may be reduced. Since in accordance with the method proposed herein, the springback force exerted on the packing material is reduced, packaging materials and methods may be more freely selected. For example, conventional paper and plastic packaging materials will provide sufficient strength to keep the stack in the compressed condition with the packing density D0. Also, conventional methods of forming packages, e.g. by forming a wrap around the stack which is fastened to itself via an adhesive may be used. For example, conventional glues for sealing a wrapper around a stack may harden sufficiently within conventional packing times, for the resulting package to comprise a packaging which is indeed able to maintain the stack at the packaging density D0 without breaking or opening.

The absorbent tissue paper material comprising at least a dry crepe material means that at least one ply of the absorbent tissue paper material shall be of a dry crepe material.

Optionally, the absorbent tissue paper material is a combination material comprising at least one ply of a dry crepe material and at least one ply of another material, preferably said another material is a structured tissue material, most preferred an ATMOS material or a TAD material.

The term "tissue paper" is herein to be understood as a soft absorbent paper having a basis weight below 65 g/m$^2$, and typically between 10 and 50 g/m$^2$. Its density is typically below 0.60 g/cm$^3$, preferably below 0.30 g/cm$^3$ and more preferably between 0.08 and 0.20 g/cm$^3$.

The fibres contained in the tissue paper are mainly pulp fibres from chemical pulp, mechanical pulp, thermo mechanical pulp, chemo mechanical pulp and/or chemo thermo mechanical pulp (CTMP). The tissue paper may also contain other types of fibres enhancing e.g. strength, absorption or softness of the paper.

The absorbent tissue paper material may include recycled or virgin fibres or a combination thereof.

For example, the absorbent tissue paper material may comprise dry crepe material only or it may be a combination of at least a dry crepe material and at least a structured tissue material.

A structured tissue material is a three-dimensionally structured tissue paper web.

The structured tissue material may be a TAD (Through-Air-Dried) material, a UCTAD (Uncreped-Through-Air-Dried) material, an ATMOS (Advanced-Tissue-Molding-System), an NTT material, or a combination of any of these materials.

A combination material is a tissue paper material comprising at least two plies, where one ply is of a first material, and the second ply is of a second material, different from said first material.

Optionally, the tissue paper material may be a combination material comprising at least one ply of a structured tissue paper material and at least one ply of a dry crepe material. Preferably, the ply of a structured tissue paper material may be a ply of TAD material or an ATMOS material. In particular, the combination may consist of structured tissue material and dry crepe material, preferably consist of one ply of a structured tissue paper material and one ply of a dry crepe material, for example the combination may consist of one ply of TAD or ATMOS material and one ply of dry crepe material.

An example of TAD is known from U.S. Pat. No. 5,853,547, ATMOS from U.S. Pat. Nos. 7,744,726, 7,550,061 and 7,527,709; and UCTAD from EP 1 156 925.

Optionally, a combination material may include other materials than those mentioned in the above, such as for example a nonwoven material.

Alternatively, the tissue paper material is free from nonwoven material.

Optionally, the selected packing density D0 is 0.25 to 0.60 kg/dm$^3$, preferably 0.25 to 0.55 kg/dm$^3$, most preferred 0.30 to 0.55 kg/dm$^3$.

Optionally, the packing density D0 is >0.20 and ≤0.35 kg/dm$^3$ and said package displaying a piston imprinting load as described herein at 3 mm imprint level IM3 being less than 130 N, preferably less than 120 N or said packing density D0 being >0.35 and ≤0.65 kg/dm$^3$ and said package displaying a piston imprinting load as described herein at 3 mm imprint level IM3 being less than 400 N, preferably less than 350 N.

Optionally, the packing density D0 is >0.20 and ≤0.35 kg/dm$^3$ and said package displaying a piston imprinting load as described herein at 6 mm imprint level IM6 being less than 500 N, preferably less than 400 N or said packing density D0 being >0.35 and ≤0.65 kg/dm$^3$ and said package displaying a piston imprinting load IM6 as described herein at 6 mm imprint level being less than 8000 N, preferably less than 6000.

Optionally, the packing density D0 is >0.20 and ≤0.35 kg/dm$^3$ and said package displaying a piston imprinting load as described herein at 6 mm imprint level IM6 being less than 300 N, preferably less than 250 N.

Optionally, the packing density D0 being >0.20 and ≤0.35 kg/dm$^3$ and said package displaying a piston imprinting load as described herein at 3 mm imprint level IM3 and a piston imprinting load at 10 mm imprint level IM10, wherein IM10/IM3 is greater than 3, preferably greater than 4, most preferred greater than 4.5; or said packing density D0 being >0.35 and ≤0.65 kg/dm$^3$ and said package displaying a piston imprinting load as described herein at 3 mm imprint level IM3 and a piston imprinting load at 10 mm imprint level IM10, wherein IM10/IM3 is greater than 4.5.

Optionally, the packing density D0 being >0.20 and ≤0.35 kg/dm$^3$ and said package displaying a piston imprinting load as described herein at 3 mm imprint level IM3 and a piston imprinting load at 6 mm imprint level IM6, wherein IM6/IM3 is greater than 1.5, preferably greater than 2; or said packing density D0 being >0.35 and ≤0.65 kg/dm$^3$ and said package displaying a piston imprinting load as described herein at 3 mm imprint level IM3 and a piston imprinting load at 6 mm imprint level IM6, wherein IM6/IM3 is greater than 2.

The packaging may be a wrapper encircling the stack at least in a direction along the height direction of the stack, preferably the packaging may be a wrap-around-strip.

Advantageously, the packaging is of a material displaying a tensile strength S(pack) along the height H of the stack being less than 10 $kN/m^2$.

Tensile strengths of materials as discussed herein are obtained by the method ISO 1924-3. The relevant tensile strength of a material is the strength along the direction thereof which will extend along the height direction of the package. This may be the Machine direction MD or the Cross direction CD of the packaging material.

Due to the reduced spring back force displayed by the stacks obtained by the method as described in the above, it is possible to pack a stack having a relatively high density in a packaging material having a relatively low strength, if compared to previous assumptions in the art. Accordingly, several materials which are convenient for use in packing stacks, such as for example paper materials and plastic films, are available.

The packaging material may surround the stack completely, so as to form a complete enclosure of the stack. However, it may be preferred only to encircle the stack using a wrap-around strip, leaving at least two opposing side surfaces of the stack uncovered.

The packaging may advantageously be formed by a single packaging part, such as a closed package or a single wrapper encircling the stack. A packaging formed by a single packaging part may be formed by several pieces of material being joined together to form the single packaging part. For example, an encircling wrapper may be formed by two wrapper pieces being joined by two seals so as to form the single wrapper. However, the packaging may also be formed by at least two packaging parts. For example, two or more separate bands, each band encircling the stack, and arranged at a distance from each other along the length L of the stack may form the packaging.

To promote a uniform appearance of the stacks, it is preferred that the packaging, when applied to the stack, extends over the full length L and width W of the stack, i.e. over the complete end surfaces of the stack.

The tensile strength of the material should be selected so as to be sufficient to maintain the stack in its compressed condition.

The packaging may advantageously be of a material displaying a tensile strength S(pack) in a direction along the height H of the stack of at least 1.5 $kN/m^2$, preferably at least 2.0 $kN/m^2$, most preferred at least 4.0 $kN/m^2$.

Advantageously, the packaging may be made of a paper, non-woven or plastic material. The packaging material may be selected so as to be being recyclable with the absorbent tissue paper material of the package. For example, the packaging may be a PE or PP film, a starch-based film (PLA), or a paper material, e.g., a coated or a non-coated paper.

Optionally, the method may comprise closing the packaging to encircle the stack by means of a seal.

The seal should be selected so as to be suitable for maintaining the packaging in a closed condition. Accordingly, the seal must be able to resist the springback force exerted by the stack towards the packaging.

The seal may be an adhesive seal. Preferably, the adhesive seal shall be of a type which is capable of developing sufficient strength for maintaining the stack in the compressed condition within a time period convenient for use in industrial manufacturing processes. Such a time period may be within maximum 30 s, or preferably within 10 s. Suitable adhesives may be hot melt adhesives, including ordinary hot melt adhesives, and pressure sensitive hot melt adhesives.

Alternatively, the seal may be an ultrasonic seal or a heatseal.

Optionally, the tissue paper material in the stack may be a discontinuous material. By a discontinuous material is meant a material which is cut to form individual sheets of the tissue paper material, for example each sheet can have a size being suitable to form a wipe or napkin.

In the stack, the individual sheets of the discontinuous material may be arranged separately. For example, the individual sheets may be separately arranged in a pile, one over the other, to form the stack. In one alternative, each such individual sheet may form a panel. In another alternative, each such individual sheet may be folded, and the folded sheets may be separately arranged in a pile to form said stack.

In the stack, the individual sheets of the discontinuous material may alternatively be arranged so as to form a continuous web.

By "continuous web" is meant herein a material which may be continuously fed in a web-like manner, e.g. when the tissue paper material is drawn from a dispenser.

To form a continuous web out of a discontinuous material comprising individual sheets, the individual sheets may be interfolded with each other, such that pulling of a first sheet implies that a second, following sheet is dragged along with the first sheet.

Optionally, the tissue paper material in the stack may be a continuous material. A continuous material may be divided into individual sheets upon or after dispensing thereof. For example a continuous material may be automatically cut to form individual sheets in a designated dispenser comprising a cutting arrangement. Optionally, the continuous material may comprise weakening lines intended to, upon separation along the weakening lines, divide the continuous web material into individual sheets. Advantageously, such weakening lines may comprise perforation lines.

The stack may comprise a single continuous material. Optionally, the stack may comprise two or more continuous materials, being folded together so as to form the stack.

A continuous material will naturally from a continuous web, in that the pulling of any material to form a first sheet will always imply that the material to form a second, following sheet is dragged along with the first sheet.

Optionally, the stack is a stack of folded absorbent tissue paper material, in which case the stack preferably comprises folding lines extending along the length (L) of the stack. Accordingly, the absorbent tissue paper material is folded to form the panels having the width W and length L of the stack. Advantageously, folding lines of the folded absorbent tissue paper material extend along the length L of the stack. Typically, the folding lines of the absorbent tissue paper material may at least partially form the sides of the stack extending in the length L and height H direction thereof.

As understood from the above, a stack of folded tissue paper material may be accomplished from a discontinuous tissue paper material as well as from a continuous tissue paper material.

The tissue paper material may be folded in different manners to form a stack, such as Z-fold, C-fold, V-fold or M-fold.

Advantageously, the stack may comprise at least one continuous web being Z-folded.

Optionally, the stack may comprise at least two continuous webs being Z-folded so as to be interfolded with each other.

Optionally, the stack may comprises a first continuous web material divided into individual sheets by means of weakening lines, and a second continuous web material divided into individual sheets by means of weakening lines, the first and second continuous web materials being interfolded with one another so as to form the stack, and the first and the second continuous web materials being arranged such that the weakening lines of the first continuous web material and the weakening lines of the second continuous web material are offset with respect to each other along the continuous web materials.

Optionally, the first continuous web material and the second continuous web material may be joined to each other at a plurality of joints along the continuous web materials, preferably the joints may be regularly distributed along the web materials.

Advantageously, the length L and width W of the stack are both greater than 67 mm, preferably greater than 70 mm.

To obtain a package as described in the above, a method as described in the following is proposed.

According to the method, a package is provided, comprising a stack of absorbent tissue paper material and a packaging. The tissue paper material in the stack forms panels having a length (L), and a width (W) perpendicular to the length (L), the panels being piled on top of each other to form a height (H) extending between a first end surface and a second end surface of the stack.

The packaging is to be adapted to maintain the stack in a compressed condition in the package, with a selected packing density D0, and a selected packing height H0. The method comprises:

forming a stack of absorbent tissue paper material;

compressing each portion of the stack in a direction along the height (H) to assume a temporary height H1 being c1×H0, where c1 is between 0.30 and 0.95; and applying the packaging to the stack.

In the method proposed herein, the stack is compressed to a temporary height H1 being less than the packing height H0, before the packaging, which is to maintain the stack at the packing height H0, is applied. It has been found that this temporary compression to a temporary height H1 being c1×H0, where c1 is in accordance with the above, reduces the tendency of the stack to reexpand from the packing height H0. Hence, when the packaging is arranged around the stack so as to maintain the stack at the packing height H0, the springback force exerted by the compressed stack towards the packaging will be relatively low. In particular, the springback force towards the packaging will be less than the springback force exerted by a similar stack being compressed directly to the packing height H0, without the preceding step of temporary compression to the temporary height H1.

Accordingly, previous problems experienced when applying a packaging to a stack of absorbent tissue paper material with the packing densities proposed herein may be reduced. Since in accordance with the method proposed herein, the springback force exerted on the packing material is reduced, packaging materials and methods may be more freely selected. For example, conventional paper and plastic packaging materials may provide sufficient strength to keep the stack in the compressed condition with the packing density D0.

Also, conventional methods of forming packages, e.g. by forming a wrap around the stack which is fastened to itself via an adhesive may be used. For example, conventional glues for sealing a wrapper around a stack may harden sufficiently within conventional packing times, for the resulting package to comprise a packaging which is indeed able to maintain the stack at the packaging density D0 without breaking or opening.

Advantageously, the packaging may be a single stack packaging, such that the package comprises a single packaging and a single stack. However, the packaging may also comprise two or more stacks, each stack being maintained at the selected packaging density D0. For example, the two or more stacks may be arranged side-by-side in the packaging.

Moreover, it has been found that in a package obtained by the method proposed herein, the absorbent tissue paper material may be provided with reduced bulk, but still being in a condition providing satisfying performance in use, and enabling easy unfolding and dispensing from the stack.

The compression of the stack so as to achieve the temporary height H1 being smaller than the packing height H0 as explained in the above, may imply that the stack is compressed to a temporary density D1 having a magnitude which has previously been deemed to be detrimental to the quality of the tissue paper material, and therefore to be avoided.

With the method proposed herein it has been realized that a temporary compression to a relatively high density D1 may be made without causing substantial damage to the quality of the tissue paper material. The quality of the tissue paper material may evaluated by studying various parameters, preferably including the wet strength and the absorption capacity of the tissue paper material.

Without being bound to theory, it is believed that a stack of absorbent tissue paper material will display what may be referred to as an elastic behavior at relatively low densities. If a stack is compressed and then released, both steps being performed at relatively low densities, the properties of the tissue paper material will not be substantially affected by the compression. On the other hand, the spring back force of the stack will also not be substantially affected by the compression. What has now been realized is that, at relatively high densities, the spring back force of the stack may be substantially affected by a temporary compression as described herein. However, the properties of the absorbent tissue paper material will not be substantially affected, or the properties will only be affected to a degree that is tolerable considering the advantages obtained by the reduced spring back force of the stack.

Another advantage obtained by the package provided by the method proposed herein is that the expansion in the height direction H of the stack after removal of the packaging will be relatively small, due to the diminished springback force exerted by the stack towards the packaging. Accordingly, any problems arising from the stack expanding after removal of the packaging may be reduced. Moreover, the obtained bulk reduction of the package may be significant not only during transport and storage of the package, but also during storage and use of the stack, for example as enclosed in a housing of a dispenser for dispensing the tissue paper material to a user.

Also, in a package where the packaging is made of a bendable or resilient material, the springback force of the stack exerted towards the packaging will conventionally cause the stack and the packaging to bulge outwardly along a longitudinal centre line of the panels of the stack. Due to the reduced springback force, a package obtained by the method as proposed herein may also be configured to display less bulging out than prior art packages comprising similar stacks with similar packing densities D0. This is advantageous in that a plurality of packages may be more densely packed for example of on a pallet during transport and storage thereof.

The packaging may be applied to the stack when the stack is held at the temporary height H1, whereafter the stack and the package may be released, so that the stack expands to the packing height H0 when inside the packaging. Alternatively, the packaging may be applied while the stack is held at any other height between H1 and H0. Also, it is conceivable that the stack, after compression to the temporary height H1 is allowed to reexpand to a height greater than the packing height H0, and then the stack is compressed again to the packing height H0 under application of the packaging. Moreover, it is conceivable that additional method steps are performed in between the various steps of the method.

The temporary height H1 is a minimum height to which each portion of the stack is compressed during the formation of the package. Possibly, different portions of the stack could be compressed to different temporary heights H1, where all temporary heights H1 fulfil the requirement H1=c1×H0 (c1 may then vary).

However, it is preferred that substantially all portions of the stack are compressed to substantially the same temporary height H1. The temporary height H1 is then the minimum height to which substantially all portions of the stack is compressed. Substantially all portions of the stack may for example correspond to at least 85% of the panel area of the stack, preferably at least 90%, most preferred at least 95%.

It will be understood, that to compress each portion of the stack to assume the temporary height H1, it might not be necessary to apply compressing pressure directly to each portion of the stack, e.g. to the entire panel area of the stack. Possibly, each portion of the stack may be brought to assume the temporary height H1 by applying compressing pressure onto only some portions of the stack, as long as this application of pressure may be made in a manner which does not damage the tissue paper material. Preferably, application of compacting pressure will take place over at least 50% of the panel area of the stack.

Advantageously, each portion of the stack is compressed to the temporary height H1 by application of compressing pressure to each portion of the stack. For example, compressing pressure may be applied over substantially the entire panel area of the stack, where substantially the entire panel area may correspond to at least at least 85% of the panel area of the stack, preferably at least 90%, most preferred at least 95%. Advantageously, compressing pressure may be applied over the entire panel area (100%) of the stack.

Advantageously, c1 may be greater than 0.30, preferably greater than 0.45, most preferred greater than 0.60. Advantageously, c1 may be less than 0.90, preferably less than 0.85.

Advantageously, c1 may be between 0.30 and 0.90, preferably between 0.45 to 0.90, most preferred between 0.60 and 0.85.

According to one alternative, the step of compressing each portion of the stack in a direction along the height (H) to assume a temporary height H1 may be performed by essentially simultaneous compression of all portions of the stack to the temporary height H1.

For example, this may be achieved by compressing the stack along the height H thereof between two essentially planar surfaces, each planar surface having dimensions greater than the panel surface area (L×W).

According to one alternative, the step of compressing each portion of the stack in a direction along the height (H) to assume a temporary height H1 may be performed by consecutive compression of each portion of the stack to the temporary height.

Consecutive compression of each portion of the stack to the temporary height may be achieved by for example by feeding of the stack through an inclined passage or a nip.

According to one alternative, the step of compressing each portion of the stack in a direction along the height (H) to assume a temporary height H1 is performed while the stack is stationary.

For example, the stack may be stationary resting on one of its end surfaces on an essentially horizontal support surface, over which a moving compressing unit is arranged to perform the compressing of each portion of the stack. The moving compressing unit may for example be a unit performing essentially simultaneous compression of the entire stack, such as a vertically moving essentially planar surface. The moving compressing unit may in another example be a unit for consecutive compression of each portion of the stack to the temporary height, such as one at least partially horizontally moving roller, being rolled over the end surface of the stack so as to consecutively compress each portion of the stack.

According to one alternative, the step of compressing each portion of the stack in a direction along the height (H) to assume a temporary height H1 is performed while the stack is moving, preferably while the stack is positioned on a moving support. Such a moving support may for example be a conveyor belt.

Embodiments where the compression is performed while the stack is moving may be particularly well-suited for use in an in line manufacturing process.

A moving stack may be combined with the compression being performed by essentially simultaneous compression of the entire stack. For example, the stack may be moved through a parallel passage, having an extension exceeding the dimension of the stack in the direction of movement, for essentially simultaneous compression of the entire stack. In this case, the entire stack will be essentially simultaneously compressed, at least when the entire stack is located in the parallel passage.

Consecutive compression of each portion of the stack may be accomplished in many different ways. Advantageously, consecutive compression may be performed while the stack is moving. For example, advantageously, a moving stack may be moved through a nip for consecutive compression of each portion of the stack to the temporary height H1.

Optionally, the moving stack may be moved through an inclined passage for consecutive compression of each portion of the stack to the temporary height H1.

Optionally, the step of compressing each portion of the stack in a direction along the height (H) to assume a temporary height H1 is adapted to maintain the height H1 for a time period (delta) greater than 0 but less than 10 min, preferably less than 60 s, most preferred less than 20 s.

It will be understood that the temporary height H1 must be maintained for a time period greater than 0 s, i.e. the compressing must take place, even if momentarily. For example, the time period may be greater than 0.1 s.

In order to ensure that the tissue paper material is not adversely affected by the compression to the temporary height, the time period (delta) may be between 0 s and 10 min, preferably between 0.1 s and 60 s, most preferred between 4 s and 20 s.

For application in in-line manufacturing processes, it is generally desired to keep the time period as short as possible, in order to keep up production speeds.

When determining the time period (delta) in a method, the time period to be considered is the time from which a first portion of the stack reaches the height ((H1+H0)/2), and until the same portion of the stack again reaches the same height ((H1+H0)/2).

Optionally, the step of forming the stack comprises: forming a log of absorbent tissue paper material, the log comprising tissue paper material for at least two, corresponding stacks, and cutting the log to form the stack.

The method may comprise forming a log comprising at least two corresponding stacks, and cutting the stack from the log. To form such a log, absorbent tissue paper material is folded to form log panels, each log panel area corresponding to at least two stack panel areas located side by side. A log may include at least 2 stacks, preferably at least 6 stacks. Usually, a log will include less than 13 stacks.

The step of cutting the log to form the stack may be performed between any of the aforementioned steps in the method. Optionally, the cutting may take place before or after the compression of the stack to the temporary height H1. Also, the cutting may take place before or after applying the packaging to the stack. When the cutting is performed after application of the packaging, the packaging may be cut to fit the stack in the same method step.

Advantageously, the log is compressed to the temporary height H1, whereafter a log packaging extending along the length of the log is applied to the log, and whereafter the log packaging and the log is cut to form the packages including a stack and its packaging.

BRIEF DESCRIPTION OF THE DRAWINGS

The proposed method and apparatus will be further described with reference to the accompanying schematic drawings, wherein:

FIG. 2*a* illustrates schematically an embodiment of a method for providing a package comprising a stack of tissue paper material and a packaging;

FIG. 2*b* illustrates schematically a variant of the method of FIG. 2*a;*

FIG. 3*a*-3*c* illustrates schematically an embodiment of a method for compressing the stack in a method according to FIG. 2;

DETAILED DESCRIPTION OF PREFERRED EMBODIMENTS

Figure 1:
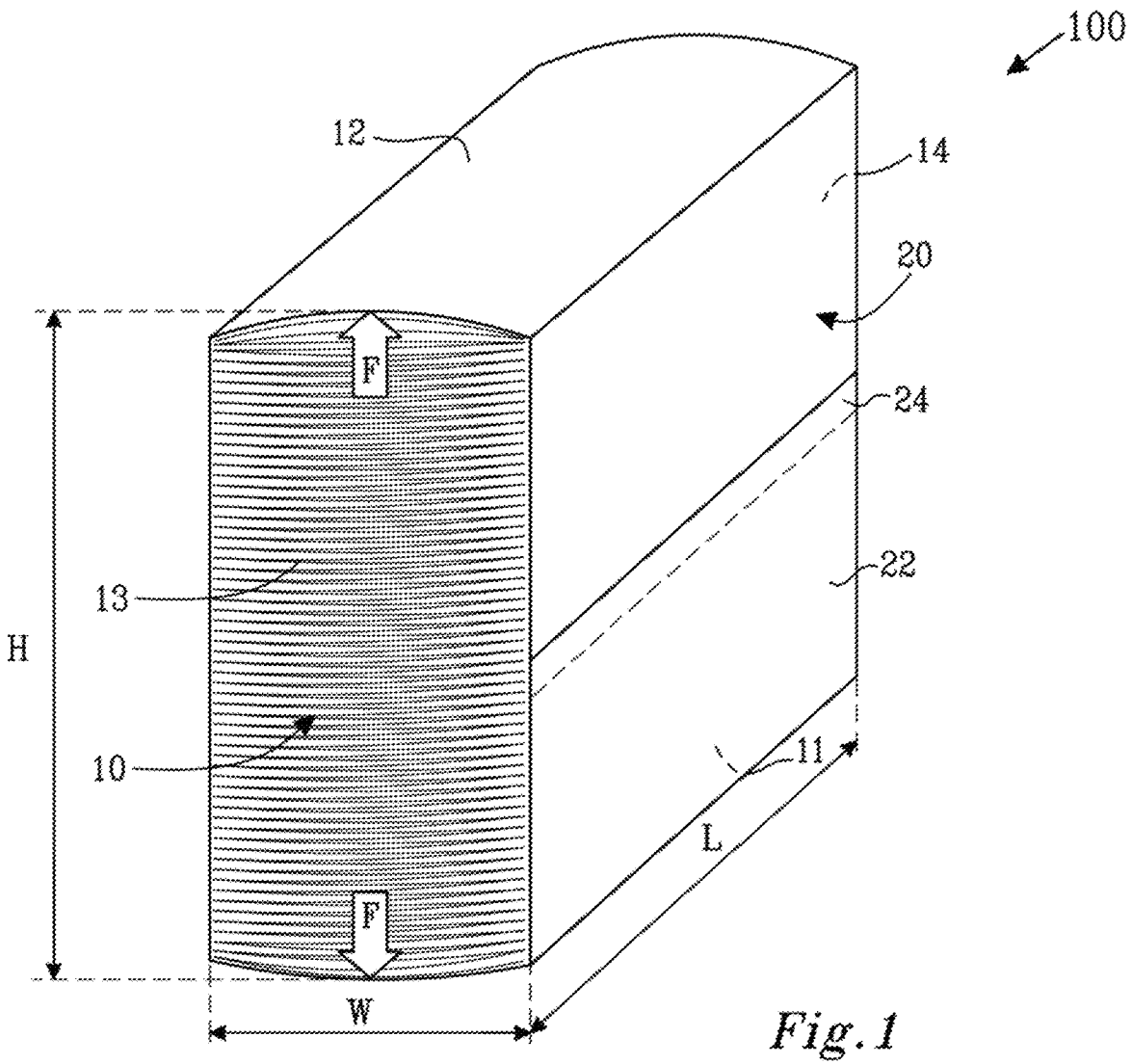
FIG. 1 illustrates schematically a package comprising a stack of tissue paper material and a packaging.

FIG. 1 illustrates schematically an embodiment of a package 100 comprising a stack 10 of absorbent tissue paper material and a packaging 20.

In the stack 10 the absorbent tissue paper material forms panels having a length L, and a width W perpendicular to the length L. The panels are piled on top of each other to form a height H, extending between a first end surface 11 and a second end surface 12 of the stack 10.

In FIG. 1, the absorbent tissue paper material is a continuous web material which is zigzag-folded such that the fold lines extend along the length L of the stack, and the distance between two fold lines along the web material corresponds to the width W of the stack.

The packaging 20 encircles the stack 10 so as to maintain the stack 10 in a compressed condition in the package 100. Accordingly, the stack 10, striving to expand, exerts a force F directed along the direction of the height H of the stack, towards the packaging 20. The force F will cause the packaging to bulge outwardly, such that the bottom and top surfaces of the packaging, corresponding to the first end surface 11 and the second end surface 12 of the stack, assumes a curved appearance.

To maintain the stack 10 in a compressed condition, the packaging 20 encircles the stack at least as along the height H direction of the stack 10.

In the embodiment illustrated in FIG. 1, the packaging 20 extends over essentially the full length L and width W of the stack. This is advantageous in that the top and bottom surface 11, 12 of the package 100 may be held uniformly, so as to promote a regular appearance of the package 100. Possibly, in other embodiments, the packaging 20 may extend over only a part or parts of the length L of the stack. Such embodiments would however result in the top and bottom surfaces 11, 12 of the stack bulging out differently in areas being covered by the packaging than in areas not being covered by the packaging, and hence in a more irregular appearance of the stack 10.

In the embodiment illustrated in FIG. 1, the packaging 20 is in the form of a wrap-around strip 22, encircling the stack as seen in a plane parallel to the width W and height H directions thereof. The packaging 20 covers the top and bottom surfaces 11,12 of the stack, and it covers the front and back surfaces, but the package 20 does not cover the lateral end surfaces 13, 14. Wrap-around strips are advantageous in that they are easy to apply during manufacture, and to remove before use of the stack. However, it is naturally also conceivable that the packaging 20 forms a closed enclosure, covering also the lateral end surfaces 13, 14.

The wrap-around strip 22 is in the illustrated embodiment closed by a seal 24. In FIG. 1, the seal 24 forms a seal line extending along the length direction of the package. The seal 24 may advantageously be formed by an adhesive, such as a hot-melt adhesive.

Alternatively, the seal 24 may be formed by any other suitable means for sealing the material of the packaging, such as by heat sealing or ultrasonic seal.

The packaging may be made by any of the packaging materials mentioned above. Preferably, the packaging is of a paper material, which may be recycled with the paper tissue material of the stack.

For example, the packaging may be of "Puro Performance", available from SCA Hygiene products, for example with surface weight 60 gsm. A suitable packaging material may be selected depending on the requirements for tensile strength thereof.

It is understood that the packaging 20 maintains the stack 10 at a selected packaging height H0 (measured as defined below). Accordingly, the packaging material, in this example the wrap around strip 22, and the seal 24 should be selected and designed to be able to resist the force F exerted by the stack 10 on the packaging 20.

The force F results from the tissue paper material in the stack being folded and compressed, and is sometimes referred to as the "spring-back" force of the stack. It is well known in the art that the spring-back force increases with increased compression of the stack along the height direction H.

As explained in the above, the spring-back force, which increases with increasing compression of the stack, has been known to cause problems for example when it comes to applying the packaging to the stack.

In FIG. 2*a*, a method for forming a package 100 comprising a stack 10 of absorbent tissue paper material and a packaging 20 is schematically illustrated.

The method comprises a step 200 of forming a stack 100 of absorbent tissue paper material. To this end, any conventional stack forming method may be used. For example, the stack may be formed by folding web material into panels being piled up to form the stack. The stack initially formed in step 200 will assume a nominal height H.

This height may be freely selected. However, the height H will, using conventional stack forming methods, be greater than the selected packing height H0. This is because conventional stack forming methods will not result in stack densities reaching the selected packing densities D0 as defined in the above for different tissue paper materials.

In a second step 210, each portion of the stack is compressed in a direction along the height H so as to assume a temporary height H1.

In a third step 220, a packaging 20 is applied to the stack 10. The packaging 20 is adapted to maintain the stack 10 in a compressed condition, in which the stack 10 assumes a packing height H0.

The temporary height H1 is to be c1×H0, where c1 is between 0.30 and 0.95.

The purpose of the second step 210, compressing each portion of the stack to a temporary height H1, is to diminish the force F exerted by the resulting stack having a height H0 towards the packaging, in the package formed.

H0 is selected such that the final stack, as maintained in the packaging 20, has a density D0 as defined in the above for different tissue paper materials Accordingly, a package comprising a stack 10 having a relatively high density D0, but a relatively low spring back force F, if compared to other stacks 10 of the same tissue paper material and with a similar density D0, is achieved.

FIG. 2*b* illustrates schematically a variant of the method of FIG. 2*a*, wherein the first step 200 of forming the stack comprises forming a log of the absorbent tissue paper material, the log comprising tissue paper material to form at least two corresponding stacks, and cutting the log to form the stack 10.

Advantageously, the log may be formed in a first stack forming procedure 200'. Thereafter, each portion of the log may be compressed to the temporary height H1 in step 210, and the packaging may be applied at step 220. Finally, in a second stack forming procedure 200", the log is cut to form said stacks 10. In yet another alternative, the log may be cut to form the stacks 10 before the package application step 220.

The step 220 of applying the packaging 20 to the stack 10 may be performed at any suitable time during the manufacturing procedure. For example, the packaging 20 may conveniently be applied while the stack 10 is compressed to the temporary height H1. Alternatively, the packaging 20 may be applied while the stack is compressed to any height smaller than the packaging height H0. If so, the subsequent release of the stack 10 will cause it to expand inside the packaging 20 so as to assume the packing height H0 in the resulting package 100.

Optionally, the packaging may be applied only after the stack 10 has been allowed to expand to the height H0.

Moreover, the packaging may be applied when the stack has a height larger than the packing height H0, in which case the packaging may be tightened until the stack 10 assumes the packing height H0.

When the method includes the forming of a log comprising several stacks, a continuous packaging material corresponding to the several stacks may be applied to the log, whereafter the log is cut together with the continuous packaging to form individual stacks encircled by their individual packagings.

According to the method proposed herein, each portion of the stack 10 shall be compressed to assume a temporary height H1.

Numerous alternatives are available for performing the compression to the temporary height H1.

FIGS. 3*a* to 3*c* illustrate schematically a first variant of a method for compressing the stack to a temporary height H1. In FIGS. 3*a* to 3*c*, the stack is illustrated as seen from a side surface (13, 14) thereof.

FIG. 3*a* illustrates schematically an initial stack 10 having a height H.

FIG. 3*b* illustrates the stack 10, when each portion of the stack 10 is substantially simultaneously compressed to the temporary height H1. To this end, the stack 10 is positioned between a support surface 31 and a compressing surface 32, being arranged in parallel and such that a distance measured perpendicular to the surfaces 31, 32 is adjustable. Both the support surface 31 and the compressing surface 32 have surface dimensions being greater than those of the panel area (width W×length L) of the stack, such that the surfaces 31, 32 may simultaneously compress the entire stack 10. To compress the stack 10 to the temporary height H1, the distance between the parallel surfaces 31, 32 is adjusted to correspond to the temporary height H1.

A package 20 is applied to the stack 10, the package being adapted to maintain the stack 10 at the packing height H0, as illustrated in FIG. 3*c*.

Figure 4A:
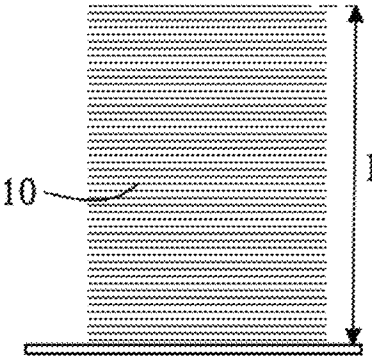
FIG. 4*a*-4*c* illustrates schematically another embodiment of a method for compressing the stack in a method according to FIG. 2.
Figure 4B:
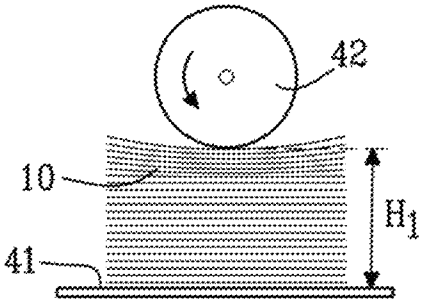
Figure 4C:
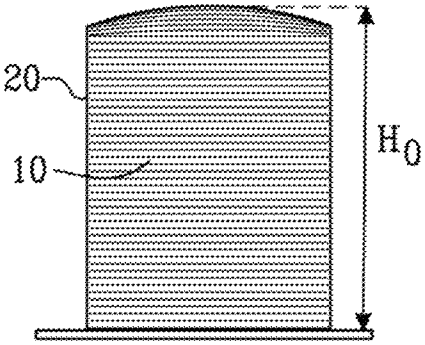

FIGS. 4*a* to 4*c* illustrate schematically a second variant of a method for compressing the stack 10 to a temporary height H1.

FIG. 4*a* illustrates schematically an initial stack 10 having a height H.

FIG. 4*b* illustrates the stack 10, when each portion of the stack 10 is consecutively compressed to the temporary height H1. To this end, the stack 10 is fed between a moving support surface 41, such as a conveyor belt, and roller 42, being arranged with its rotational axis in parallel to the support surface 41. The minimum distance between the outer periphery of the roller 42 and the support surface 41 is to correspond to the temporary height H1. A stack 10, positioned on the moving support 41 is fed through the nip formed between the moving support 41 and the roller 42, such that each portion of the stack consecutively assumes the temporary height H1.

The orientation of the stack 10 in relation to the roller 42 may be varied. For example, the stack may be fed in a direction such that a rotational axis of the roller 42 is parallel with the length direction L of the stack 10 as indicated in FIG. 4*a*. In another example, the stack may be fed in a direction such that the rotational axis of the roller 42 is parallel with the width W of the stack 10.

Thereafter, a package 20 is applied to the stack 10, the package being adapted to maintain the stack 10 at the packing height H0, as illustrated in FIG. 4*c*.

The method as illustrated in FIGS. 4*a* to 4*c* may be particularly advantageous for feeding a log (comprising several corresponding stacks) along a length direction thereof through a nip formed between the roller 42 and the moving support surface 41.

Figure 5A:
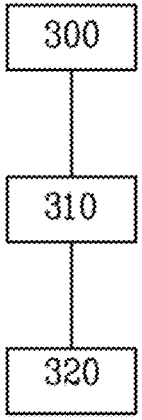
FIG. 5*a*-5*b* illustrates schematically an embodiment of an apparatus for providing a package comprising a stack of tissue paper material and a packaging.

FIG. 5*a* illustrates schematically an embodiment of an apparatus for providing a package comprising a stack of tissue paper material and a packaging, in accordance with the method of FIG. 2*a*.

The apparatus comprises:

stack forming members 300 for forming a stack of absorbent tissue paper material, wherein the tissue paper material forms panels having a length (L), and a width (W) perpendicular to the length (L), the panels being piled on top of each other to form a height (H) extending between a first end surface and a second end surface of the stack;

a compressing unit 310 for compressing the stack in a direction along the height (H) to a compacted height H1 being c1×H0, where c1 is between 0.30 and 0.95 such that each portion of the stack is subject to a compacting pressure PC of at least 1 kPa; and a packaging unit 320 for applying a packaging to the stack so as to maintain the stack with the selected height H0 in the package.

The function of the stack forming members 300, the compressing unit 310 and the packaging unit 320 corresponds to the description in the above of the method steps of the method.

Figure 5B:
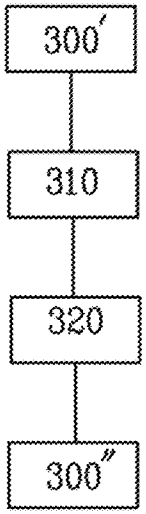

FIG. 5*b* illustrates schematically a variant of the apparatus of FIG. 5*a*, for performing a method as described in relation to FIG. 2*b*. The stack forming members 300 comprise log forming members 300', and log cutting members 300". The log forming members 300' are arranged upstream of the compressing unit 310, and the packaging unit 320. Downstream the packaging unit 320, log cutting members 300" are arranged. In yet another alternative, the log cutting members 300" may be arranged in between the compressing unit 310 and the packaging unit 320.

Indeed, it will be understood that the packaging unit 320 may be arranged at any suitable location in the apparatus, corresponding to the package application step 220 as discussed in the above in relation to FIGS. 2*a* and 2*b*.

In the apparatus, numerous alternatives for forming the stack compressing unit 310 are available. In particular, compressing unit 310 may be adapted to perform the compression of the stack 10 while the stack is stationary, for example as exemplified in FIG. 3*a*-3*c*, or while the stack is moving, for example as exemplified in FIG. 4*a*-4*c*.

Figure 6:
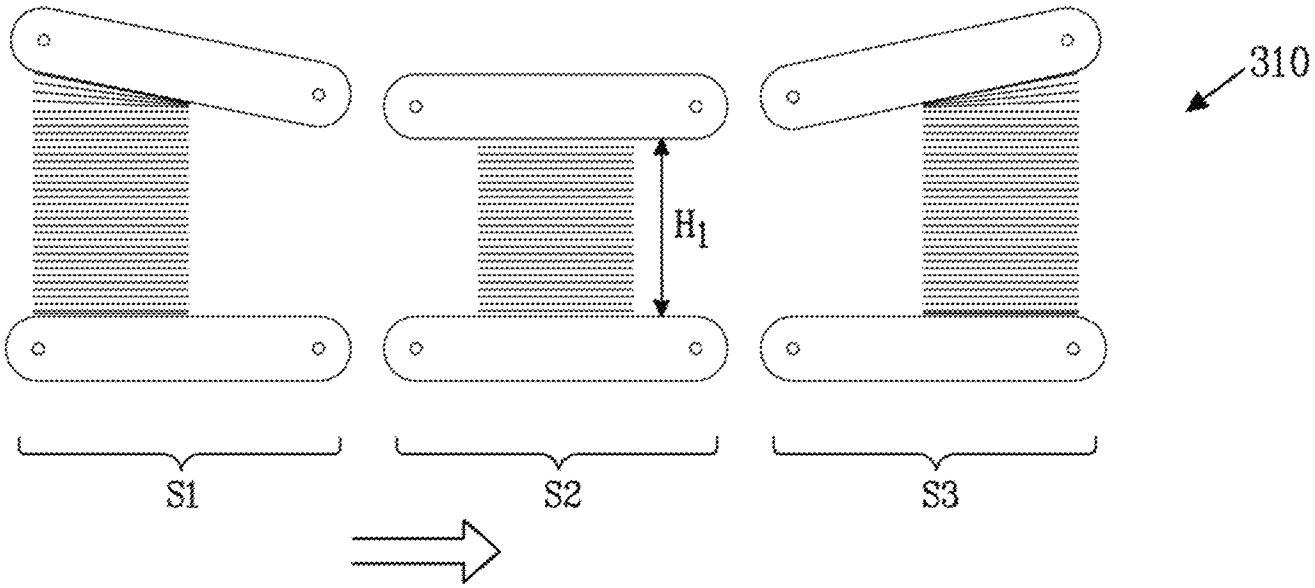
FIG. 6 illustrates schematically an embodiment of a compressing unit a stack in an apparatus according to FIG. 5.

FIG. 6 illustrates schematically an embodiment of a compressing unit 310 for performing the step 210 of compressing the stack 10 to the temporary height H1. The compressing unit 310 comprises oppositely arranged conveyor belts between which the stack 10 is fed in a downstream direction as illustrated from the left to the right by the arrow in FIG. 6. The stack 10 is to be positioned such that its height direction extends between the opposing conveyor belts. In a first section S1 of the conveyor belts, the distance between the opposing conveyor belts is gradually narrowing, thereby compressing the stack traveling between the belts. The distance between the opposing conveyor belts narrows until substantially the temporary height H1. In a second section S2 of the conveyor belts, the distance between the opposing conveyor belts is held substantially constant at the temporary height H1. In a third section S3, the distance between the opposing conveyor belts may widen, so as to allow the stack 10 to reexpand from the temporary height H1.

Figure 7:
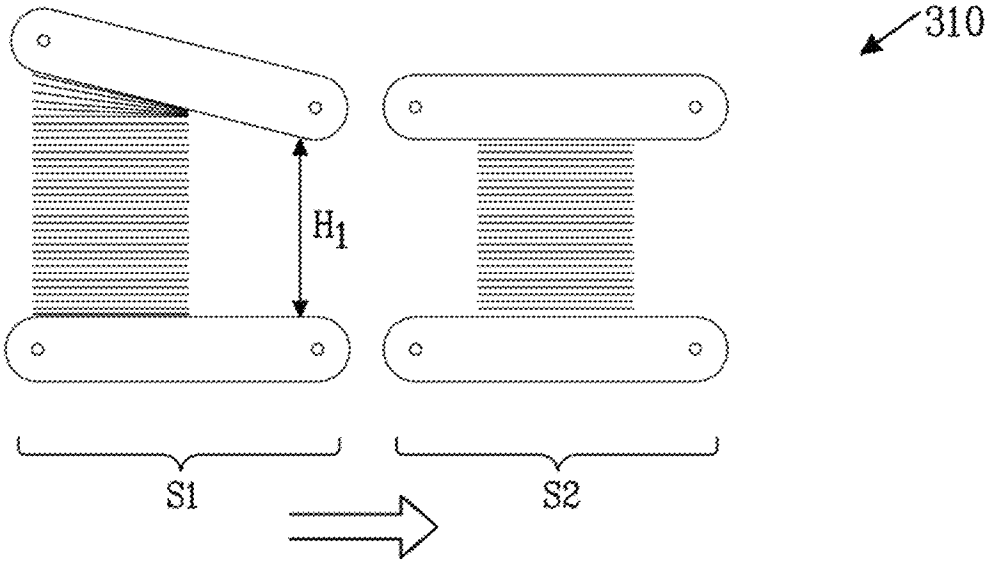
FIG. 7 illustrates schematically another embodiment of a compressing unit a stack in an apparatus according to FIG. 5.

FIG. 7 illustrates schematically another embodiment of a compressing unit 310 for performing the step 210 of compressing the stack 10 to the temporary height H1. The compressing unit 310 comprises oppositely arranged conveyor belts between which the stack 10 is fed in a downstream direction as illustrated from the left to the right by the arrow in FIG. 7. The stack 10 is to be positioned such that its height direction extends between the opposing conveyor belts. In a first section S1 of the conveyor belts, the distance between the opposing conveyor belts is gradually narrowing, thereby compressing the stack traveling between the belts. The distance between the opposing conveyor belts assumes the temporary height H1 at the end of the first section S1. In the second section S2 of the conveyor belts, the distance between the opposing conveyor belts is already greater than the temporary height H1, being the minimum height to which each portion of the stack is compressed.

The orientation of the stack in relation to the compressing unit may be varied.

Regardless of which method for compressing the stack 10 and corresponding compressing unit 310 is used, it will be understood that the compression to the temporary height H1 will take place during a time period delta which is greater than zero. In theory, the time period delta during which the compression to the temporary height H1 occurs may be infinitesimal, i.e. >0. In practice, the time period delta will be at least greater than 0.1 s.

In continuous manufacturing processes, the time period delta may advantageously be less than 60 s, most preferred less than 20 s. In this case, the time period delta will be less than, and usually well below 10 min.

In manufacturing processes using an accumulator, the time period delta may be larger than in continuous manufacturing processes, but preferably still less than 10 min.

When determining the time period delta, the time may be measured from the instance when the stack first reaches the height (H0−H1)/2 before it assumes the temporary height H1, until the stack reaches the height (H0−H1)/2 again after having assumed the temporary height H0. Measurements may be performed e.g. using a High Speed Camera.

Figure 8:
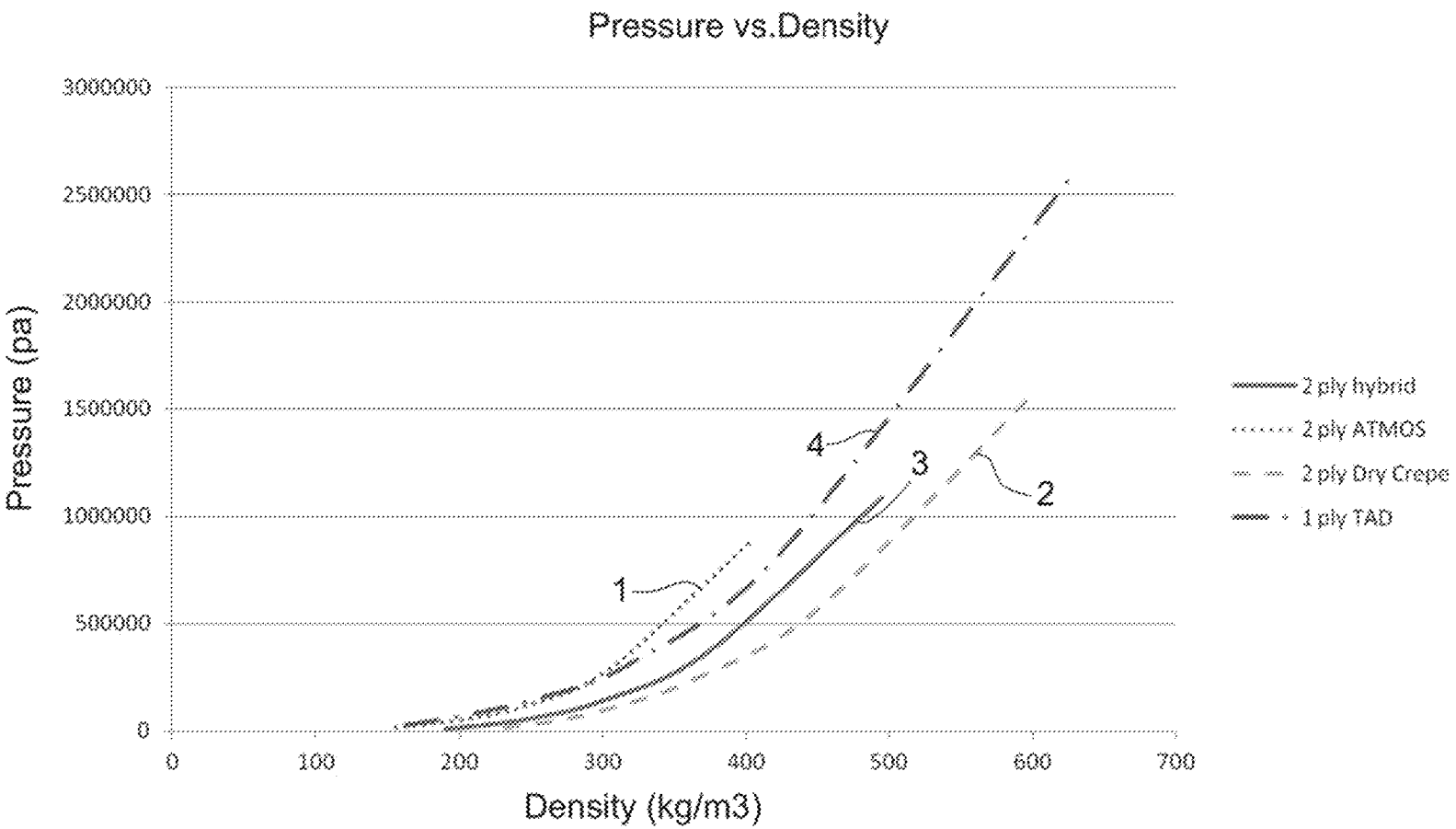
FIG. 8 is a diagram displaying the pressure required to obtain a stack of a selected density for different tissue paper materials.

FIG. 8 is a diagram depicting the pressure required to compress a stack comprising tissue paper material of different qualities to different densities. The pressure is indicated in Pa and the density in kg/m$^3$. (100 kg/m$^3$=0.1 kg/dm$^3$.)

The tissue paper materials tested are:

| Quality | SCA art no | Description |
|---|---|---|
| 1 | 100297 | 2 plies of structured tissue material, namely ATMOS material. 2 × 20.5 gsm. Décor laminated. M-folded. Stack length: 212 mm, stack width 85 mm. |
| 2 | 140299 | 2 plies of Dry crepe material. 2 × 18 gsm. Edge embossed. Z-folded. Stack length: 212 mm, stack width 85 mm. |
| 3 | 120288 | Combination material comprising 1 ply of structured tissue material, namely ATMOS, and 1 ply of dry crepe material. 2 × 18 gsm. Décor laminated. M-folded. Stack length: 212 mm, stack width 85 mm. |
| 4 | MB 554 | 1 ply of structured tissue material, namely TAD. 29 gsm. Stack length: 212 mm, stack width 92 mm. |

The tissue paper materials of the different qualities were formed into stacks having a length and width as indicated in the table above. Folding lines extend along the length dimension L of the stacks.

The starting density in FIG. 8 was achieved at a height of the stacks being about 130 mm.

Each stack was positioned on a horizontally arranged, planar support surface with dimensions exceeding the length and width L, W dimensions of the stack, such that the stack extends substantially perpendicularly from the support surface in an essentially vertical direction along the height H of the stack. An essentially planar pressure surface, also having dimensions exceeding the length and width, L, W dimensions of the stack was arranged to extend parallel to said support surface and being movable along said vertical direction. The pressure surface was lowered towards the support surface, thereby exerting a pressure on the stack being compressed between the support surface and the pressure surface. The vertical distance between the pressure surface and the support surface was recorded, corresponding to the height H of the stack during the compression. Simultaneously, the force required for pressing the pressure surface towards the support surfaces was recorded, being the force required for compressing the stack to the corresponding height H. Finally, the recorded force and height measurements were converted to corresponding pressures and densities of the stack using the length L and width W dimensions, and the weight of the stack.

The results of FIG. 8 indicate, for each selected packaging density D0, the required pressure PC for obtaining that packaging density D0, for a tested paper tissue material. Similarly, for each corresponding temporary density D1 (corresponding to a temporary height H1), the pressure PC required for obtaining that temporary density D1 is found.

Accordingly, to perform the method as described in the above for a stack of a selected tissue paper material, a pressure—density curve as depicted in FIG. 8 may be assembled for the selected tissue paper material, and type of stack, and the pressures and/or heights required to perform the method on such a stack may be collected form the pressure-density curve.

Figure 9A:
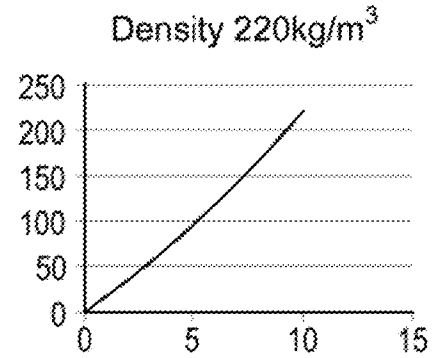
FIG. 9*a* to 9*a*''' are diagrams displaying the result of piston imprint load measurements performed on a package.
Figure 9A:
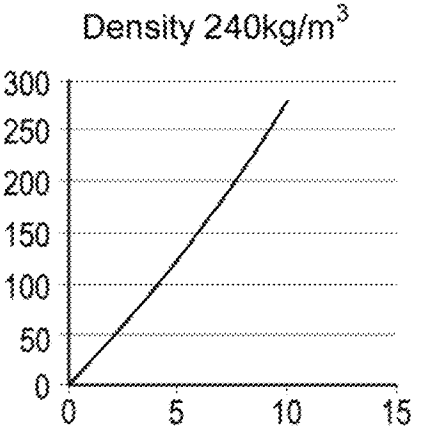
Figure 9A:
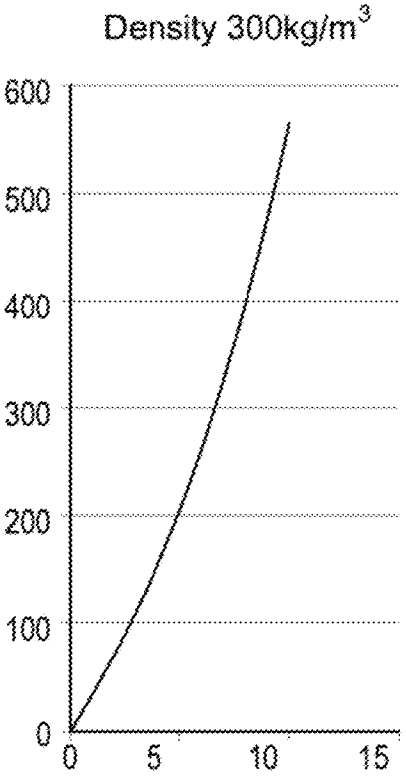
Figure 9A:
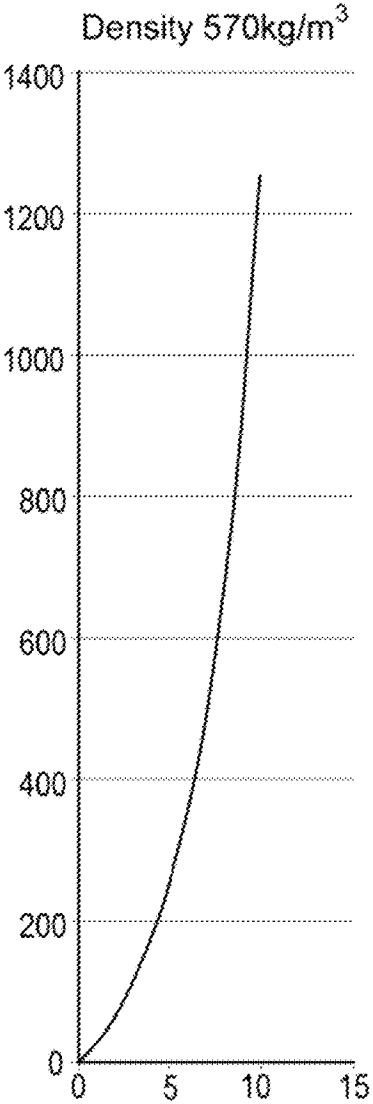

FIG. 9*a*-9*a*''' illustrates a result of performing a Piston Imprint Measurement in accordance with the method as explained in the below, on a sample package. In the piston imprinting load curve, the force F(N) required to press a piston into the package a selected distance—"imprint level"—from a nominal height H0 of the package is plotted in relation to said imprint level, as explained in the method description in the below.

The tissue paper material in the sample package is a combination material consisting of one ply of a dry crepe material, and one ply of an ATMOS material. The tissue paper material is available under Art. No. 120288 provided by SCA Hygiene products (Quality 3 in the above).

The packaging was in the form of a wrap-around strip, extending over the full length and width dimensions of the stack. The wrap around strip consisted of two parts, joined at two separate joints, extending along the length L of the package, by a hot melt adhesive. The packaging material was "Puro Performance", available from SCA Hygiene products, with surface weight 60 gsm.

The tested packages had dimensions similar to the ones described in the table above, Quality 3.

The packages were obtained using a method as described in the above, wherein each stack was compressed to a temporary height H1 of 40 mm during a time period of about 2 min. The packaging height H0 of each package was 65 mm.

The amount of tissue paper material in each package was selected (i.e. the weight of the stack was selected) so as to achieve the different packing densities D0

In FIG. 9*a*-9*a*''', the piston imprint measurement curves for four different packages are displayed as an example. In FIG. 9*a*, the packaging density D0 was 0.22 kg/dm3, in FIG. 9*a*', the packaging density D0 was 0.24 kg/dm3, in FIG. 9*a*'', the packaging density D0 was 0.30 kg/dm3, and in FIG. 9*a*''', the packaging density D0 was 0.57 kg/dm3.

Corresponding curves may be achieved by performing the piston imprint measurement method at a selected number of packages with different densities.

As seen in FIGS. 9*a*-9*a*''', the force required for pressing the piston into the package is relatively low at initial imprint levels, about 3 mm. This is believed to be a result of the method of manufacturing the package, resulting in the spring back force exerted by the stack towards the packaging when inside the package being relatively low.

Piston imprint measurement curves corresponding to those exemplified in FIGS. 9*a*-9*a*''' may be gathered for any packages being obtained by the method as described in the above.

Figure 9B:
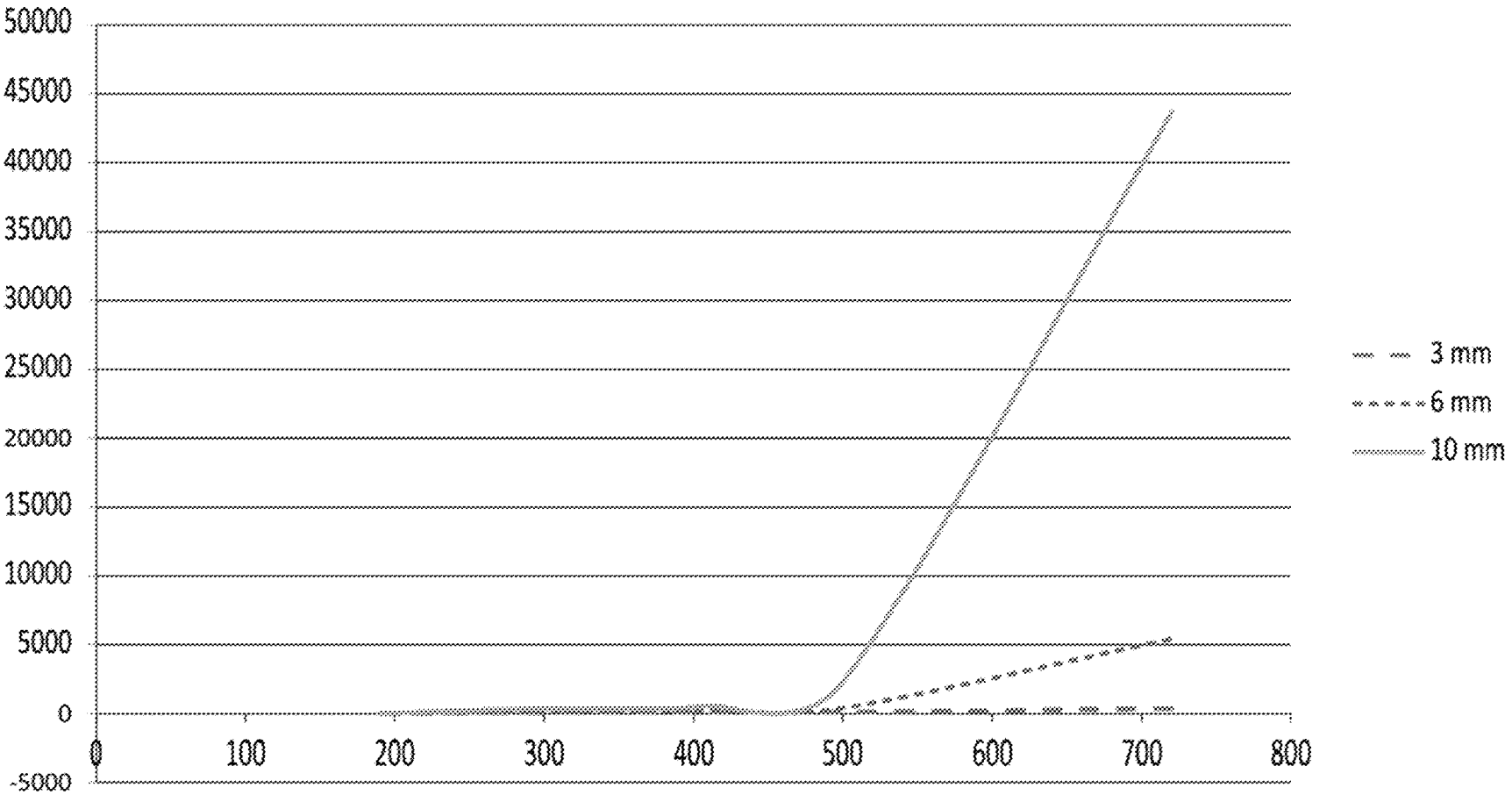
FIG. 9*b* and FIG. 9*b*' are diagrams displaying the results of piston imprint load measurements performed on a number of packages with different densities comprising a dry crepe material.
Figure 9B:
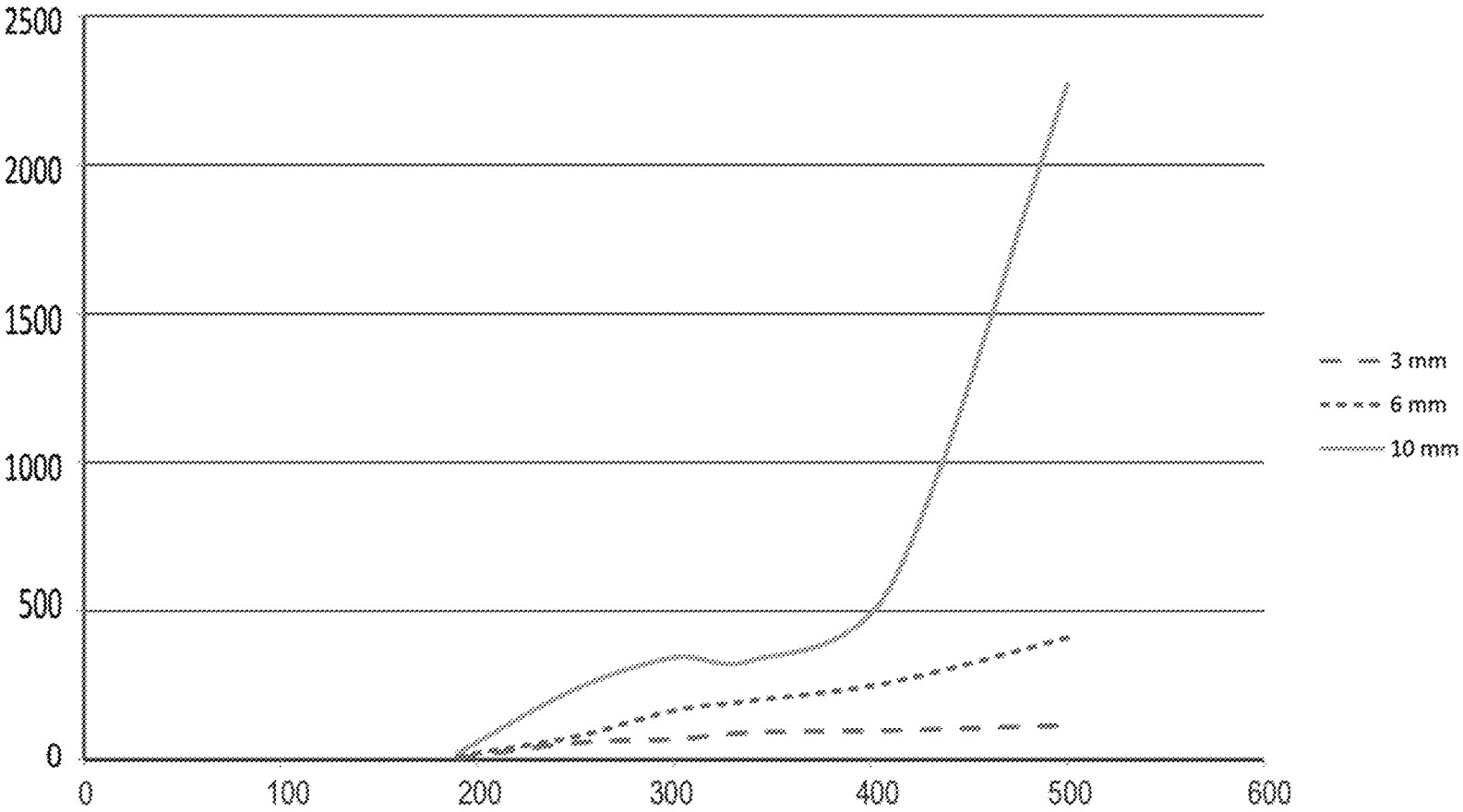

FIG. 9*b* is an assembly of data achieved from piston imprint load curves of packages with different densities D0, but with the same paper tissue material in the stack. FIG. 9*b*' is an enlargement of a portion of FIG. 9*b*.

In FIGS. 9*b*-9*b*', the density is reported on the horizontal axis in g/cm$^3$, and the piston imprint load is reported on the vertical axis in N.

To obtain a diagram similar to that of FIG. 9*b*, packages of the selected paper tissue material to be tested are manufactured with different packing densities D0, and a piston imprint load curve as described in relation to FIG. 9*a* is recorded for each packing density D0.

Thereafter, the resulting piston imprint loads for three selected imprint levels, namely 3 mm, 6 mm, and 10 mm are plotted in relation to the packing densities D0.

A diagram as the one in FIG. 9*b* is believed to be indicative of the springback properties of the stack of the package tested.

In FIG. 9*b*, the tissue paper material in the sample packages was a dry crepe material available under Art. No. 140299, provided by SCA Hygiene products, being material no 2 in the table in the above. Details about the material and the stacks are similar to those indicated in the table.

Accordingly, the stacks of the packages all had a length of 212 mm and a width of 85 mm.

The packages were obtained using a method as described in the above, wherein each stack was compressed to a temporary height H1 of 40 mm during a time period of about 2 min. The packaging height H0 of each package was 65 mm.

The amount of tissue paper material in each package was selected (i.e. the weight of the stack was selected) so as to achieve the different packing densities D0.

The packaging was similar to the one described in relation to FIGS. 9*a*-9*a'''*.

As may be seen in FIGS. 9*b*-9*b'*, for all tested densities, the piston imprint load at 3 mm imprint level IM3 stayed below 200 N, indicating that the force exerted by the stacks towards the respective packaging, when in a relaxed condition, was relatively low. For densities less than or equal to 0.35 kg/dm$^3$, the piston imprint load at 3 mm imprint level IM3 was even below 130 N, and below 100 N.

As may be seen in FIGS. 9*b*-9*b'*, for all tested densities, the piston imprint load at 6 mm imprint level IM6 was below 6000 N, even below 4000 N. For densities less than or equal to 0.35 kg/dm$^3$, the piston imprint load at 6 mm imprint level IM6 stayed below 500N, even below 300N.

If studying the relationship between imprint levels in FIGS. 9*b*-9*b'*, it is found that the ratio between the piston imprinting load at 10 mm imprint level IM10 and the piston imprinting load at 3 mm imprint level IM3, being IM10/IM3, is greater than 3, even greater than 4 at densities less than or equal to 0.35 kg/dm$^3$. For densities between 0.35 and 0.65 kg/dm$^3$, the ratio IM10/IM3 is greater than 4.5.

Without being bound by theory, it is believed that a relatively high ratio IM10/IM3 indicates that the springback force exerted by the stack towards the packaging is relatively low.

Moreover, it may be found that the ratio between the piston imprinting load at 6 mm imprint level IM6 and the piston imprinting load at 3 mm imprint level IM3, being IM6/IM3, is greater than 1.5, even greater than 2 at densities less than or equal to 0.35 kg/dm$^3$. For densities between 0.35 and 0.65 kg/dm$^3$, the ratio IM10/IM3 is greater than 2.

Figure 9C:
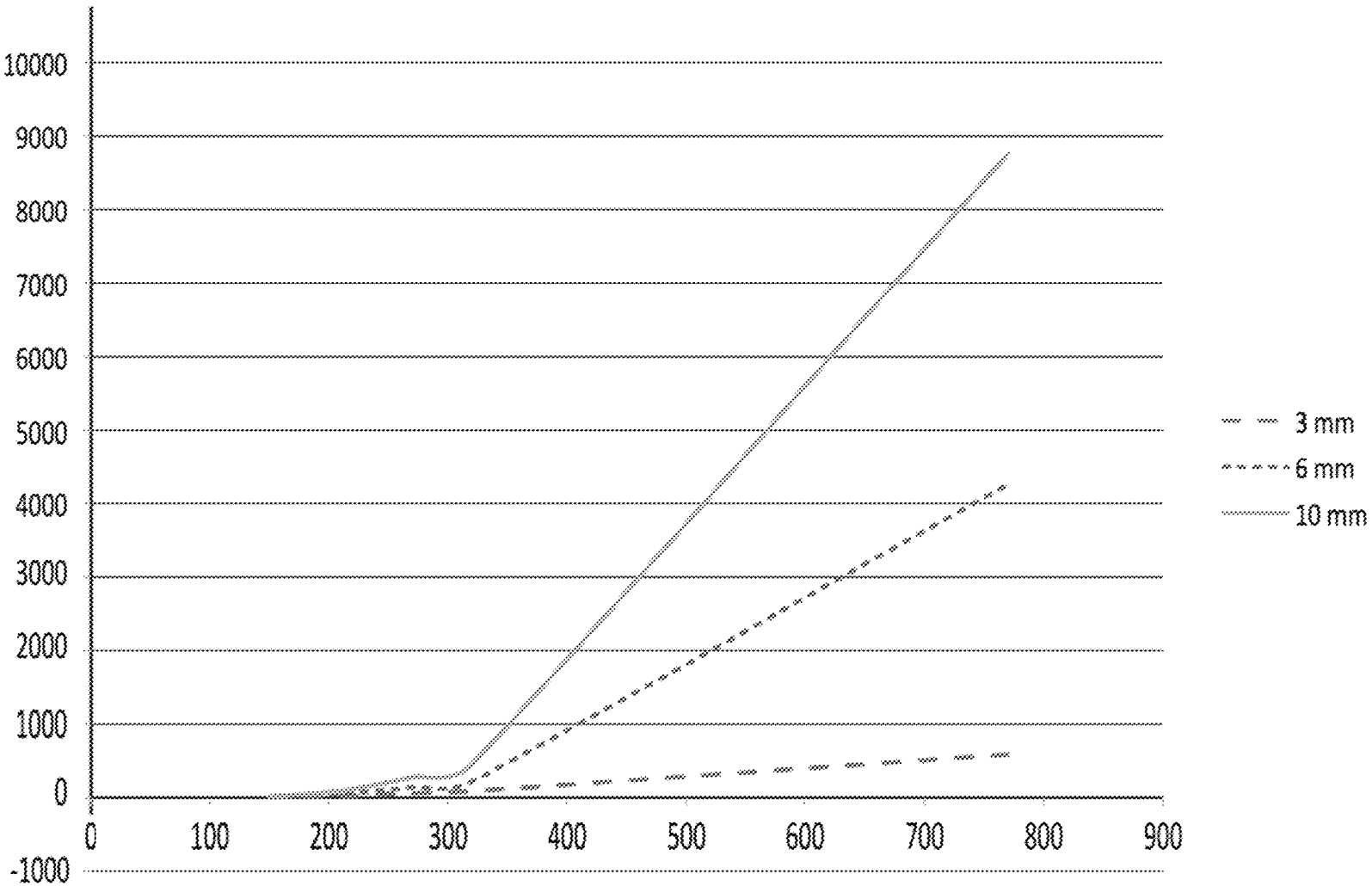
FIG. 9*c* and FIG. 9*c*' are diagrams displaying the results of piston imprint load measurements performed on a number of packages with different densities comprising a combination material comprising a dry crepe material and a structured tissue material.
Figure 9C:
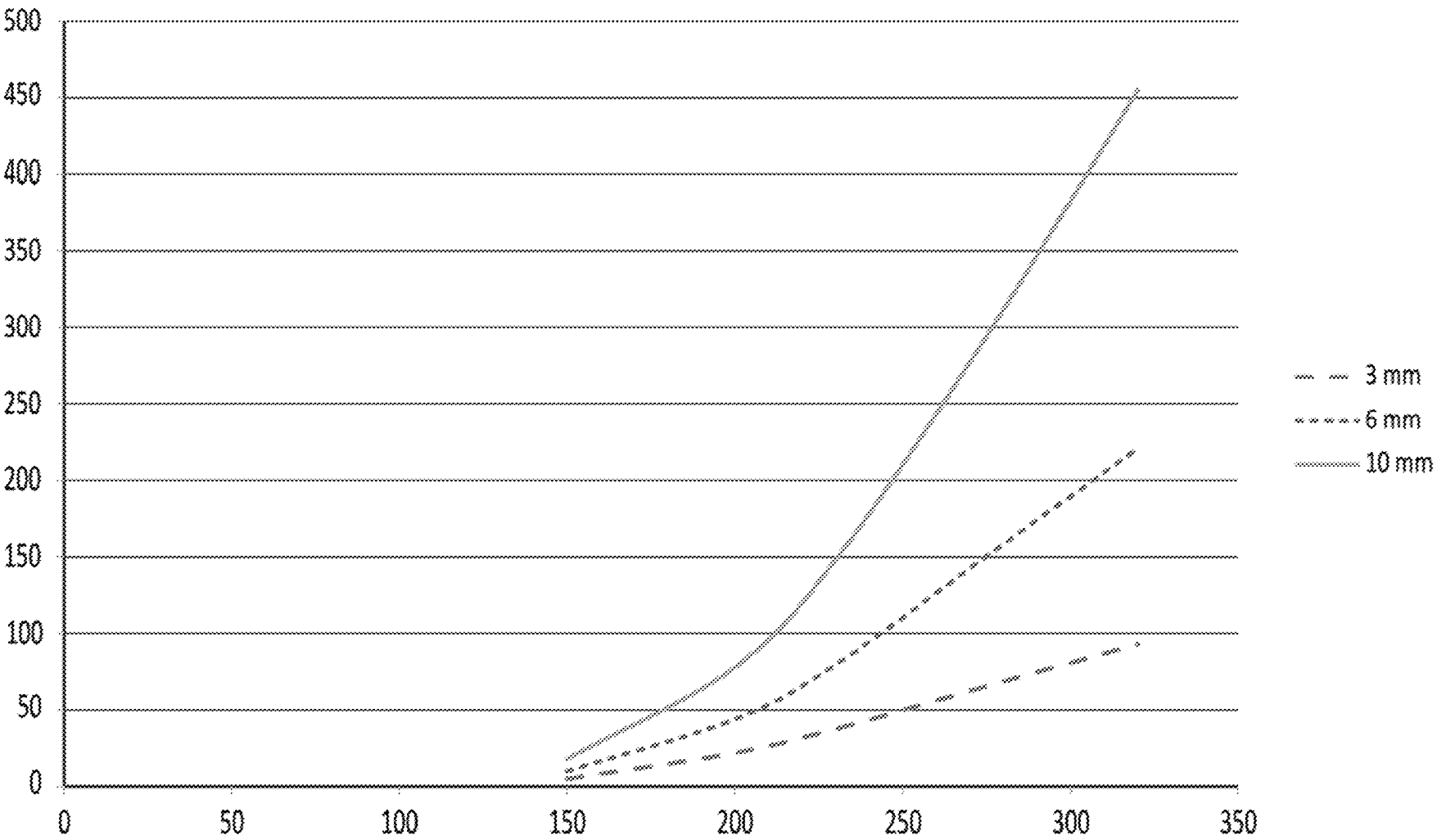

In FIG. 9*c* the tissue paper material in the sample packages is a combination material consisting of one ply of a dry crepe material, and one ply of an ATMOS material. The tissue paper material is available under Art. No. 120288 provided by SCA Hygiene products, being material no 3 in the table in the above. Details about the material and the stacks are similar to those indicated in the table. FIG. 9*c'* is an enlargement of a portion of FIG. 9*c*.

Accordingly, the stacks of the packages all had a length of 212 mm and a width of 85 mm. The packages were obtained using a method as described in the above, wherein each stack was compressed to a temporary height H1 of 40 mm during a time period of about 2 min. The packaging height H0 of each package was 65 mm.

The amount of tissue paper material in each package was selected (i.e. the weight of the stack was selected) so as to achieve the different packing densities D0.

The packaging was similar to the one described in relation to FIGS. 9*a*-9*a'''*.

In FIGS. 9*c*-9*c'*, the density is reported on the horizontal axis in g/cm$^3$, and the piston imprint load is reported on the vertical axis in N.

As may be seen in FIG. 9*c* and FIG. 9*c'*, for all tested densities, the piston imprint load at 3 mm imprint level IM3 stayed below 500 N, indicating that the force exerted by the stacks towards the respective packaging, when in a relaxed condition, was relatively low. For densities less than or equal to 0.35 kg/dm$^3$, the piston imprint load at 3 mm imprint level IM3 was even below 130 N.

As may be seen in FIG. 9*c* and FIG. 9*c'*, for all tensed densities, the piston imprint load at 6 mm imprint level IM6 stayed below 6000N, even below 4000N. For densities less than or equal to 0.35 kg/dm$^3$, the piston imprint load at 3 mm imprint level IM3 was below 500 N, even below 300 N.

If studying the relationship between imprint levels in FIG. 9*c* and FIG. 9*c'*, it is found that the ratio between the piston imprinting load at 10 mm imprint level IM10 and the piston imprinting load at 3 mm imprint level IM3, being IM10/IM3, is greater than 3, even greater than 4 at densities less than or equal to 0.35 kg/dm$^3$. For densities between 0.35 and 0.65 kg/dm$^3$, the ratio IM10/IM3 is greater than 4.5.

Without being bound by theory, it is believed that a relatively high ratio IM10/IM3 indicates that the springback force exerted by the stack towards the packaging is relatively low.

Moreover, it may be found that the ratio between the piston imprinting load at 6 mm imprint level IM6 and the piston imprinting load at 3 mm imprint level IM3, being IM6/IM3, is greater than 1.5, even greater than 2 at densities less than or equal to 0.35 kg/dm$^3$. For densities between 0.35 and 0.65 kg/dm$^3$, the ratio IM10/I3 is greater than 2.

In view of the above, packages displaying a favorable behavior in view of one or all of the issues as set out in the introduction may be achieved. As explained in the above, different paper tissue material may be used in the stacks, and different types of packaging.

Method for Determining the Density of a Stack

Density is defined as weight per volume and reported in kg/dm$^3$.

As defined in the above, in the stack of tissue paper material the tissue paper material forms panels having a length (L), and a width (W) perpendicular to the length (L), the panels being piled on top of each other to form a height (H). The height (H) extends perpendicular to the length (L) and width (W), and between a first end surface and a second end surface of the stack.

The volume of a stack is determined as L×W×H.

Sample stacks are conditioned during 48 hours to 23° C., 50% RH.

Height Determination

If the density to be determined is the density of a free stack, the following height determination procedure should be followed:

For determining the height (H) of a stack, the stack is positioned on a generally horizontal support surface, resting on one of its end surfaces (11), so that the height (H) of the stack will extend in a generally vertical direction.

At least one side of the stack may bear against a vertically extending support, so as to ensure that the stack as a whole extends in a generally vertical direction from the supported end surface.

The height (H) of the stack is the vertical height measured from the support surface.

A measurement bar held parallel to the horizontal support surface, and parallel to the width (W) of the stack is lowered towards the free end surface (12) of the stack, and the vertical height of the bar when it touches the stack is recorded.

The measurement bar is lowered towards the free end surface of the stack at three different locations along the length (L) of the stack. The first location should be at the middle of the stack, i.e. ½ L from each longitudinal end (13, 14) thereof. The second location should be about 2 cm from the first longitudinal end (measured along the length (L)) and the third location at about 2 cm from the second longitudinal end (measured along the length (L)).

The height (H) of the stack is determined to be a mean value of the three height measurements made at the three different locations.

It will be understood, that when the above-mentioned height determination method is performed, and when the stack is not perfectly rectangular but for example the end surfaces bulges outwards, the height will correspond to a maximum height of the stack.

If the density to be determined is the density of a stack when included in a package, the height measurement procedure outlined in the above should naturally be performed when the stack is included in the package. Most packaging materials used in the art are rather thin, and their thickness will not affect the measurement significantly. Should a packaging material have a thickness such that the material may significantly include the measurement, the thickness of the packaging material may be determined after removal thereof from the stack, and the value achieved during the height measurement procedure may be adjusted accordingly.

If the density to be determined is the density of stack when subject to restraint of some other kind, such as when the stack is compressed between two essentially parallel surfaces, the height of the stack corresponds to the distance between the surfaces.

If a stack is passed through a passage for compression thereof, the minimum distance between opposing surfaces of the passage, along the height direction of the stack, will correspond to the temporary height H1 to which each portion of the stack is compressed.

Length and Width Determination

The length (L) and width (W) of the stack is determined by opening the stack and measuring the length (L) and width (W) of the panels of in the stack. Edges and/or folds in the tissue paper material will provide necessary guidance for performing the length (L) and width (W) measurements.

Under practical circumstances, it is understood that the length and width of a stack may vary for example during compression and relaxation of the stack. Such variations are however deemed not significant for the results required herein. Instead, the length (L) and width (W) of the stack are regarded to be constant and identical to the length (L) and width (W) as measured on the panels.

Weight

The weight of the stack is measured by weighing to the nearest 0.1 g with a suitable calibrated scale.

To determine the density of a stack when inside a package, the package should naturally be removed before weighing the stack.

In view of the above, densities and heights of stacks may be determined.

Considering the materials and pressures relevant for this application, any expansion of the stack in the length and width directions when the stack is subject to compression will not assume magnitudes so as to be of significant importance of the result.

Accordingly, for assessing the density of a stack, and if desired the variation of the density during compression and release of the stack, it is sufficient to consider the variations in height of the stack and to assume a constant panel area of the stack.

Piston Imprinting Load Measurement

To evaluate the state of a stack, in terms of its compactness, but also regarding its tendency to expand, measurements are performed of the force required for pressing a piston selected distances into the stack. The piston is pressed towards an end surface of the stack, and in a direction along the height (H) of the stack.

Description of the Equipment

A universal testing machine, e.g. Z100 supplied by Zwick/Roell is used with a 50N load cell.

Figure 10C:
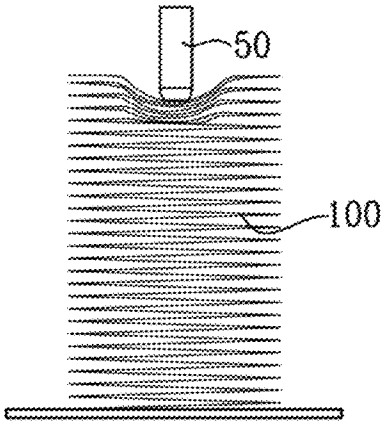
FIG. 10*a*-10*c* illustrates schematically the test equipment for use for the piston imprinting load measurements.
Figure 10B:
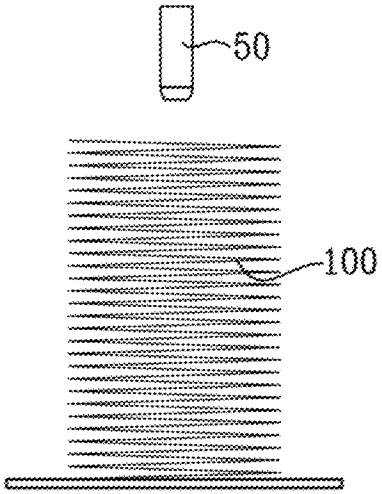
Figure 10A:
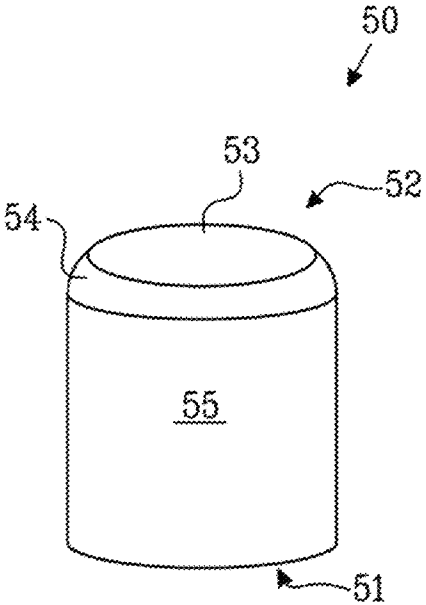

FIG. 10 illustrates schematically the measurement equipment, comprising the piston 50.

The piston 50 has inward end 51 which is adapted to be connected to the testing machine.

The piston 50 has an outward end 52 for contacting the stack 10.

The outward end 52 of the piston 50 comprises an essentially planar circular outer end surface 53 having a diameter of 33.5 mm. The outward end of the piston also comprises a conical surface 54 extending radially outwards from the planar outer end surface. The conical surface 54 forms an angle of 45° with the planar outer end surface 53, and tapers longitudinally inward from the outer end surface 53, see FIG. 10. The conical edge surface 54 extends radially to a diameter of 36 mm. Thereafter, the outer surface of the piston 50 forms a cylindrical surface 55 extending towards the inward end 51 of the piston 50.

Preferably, at least 15 mm of stack material should extend radially around the outer circumference of the piston (with 36 mm diameter) during the measurements.

The bottom support consists of a horizontally arranged, planar plate of steel with larger dimensions than the tested stack's width W and length L dimensions.

The piston 50 is mounted in the test equipment with its planar outer end surface 53 parallel to the bottom support. The piston 50 is mounted so as to be vertically movable, in a direction essentially perpendicular to the bottom support.

Description of Stack and Conditioning

Sample stacks are conditioned during 48 hours to 23° C., 50% RH.

The packaging is not removed, but remains encircling the stack during measurements.

Description of Testing Procedure

The package is arranged resting on an end panel surface (11) on a bottom support surface being essentially planar and arranged essentially horizontally. The bottom support surface may be a steel plate.

The outer end surface 53 of the piston is arranged essentially parallel to the bottom support plate, and is moved towards the bottom support plate along a perpendicular direction thereto, and at a speed of 100 mm/min.

The piston shall be positioned at the centre of the end surface of the package, i.e. a longitudinal centre axis of the piston shall coincide with a longitudinal centre axis through the end surface of the stack, as seen along the length L and width W directions thereof.

The piston is pressed into the package over a selected distance, and the force required for pressing is continuously measured by the universal testing machine.

In a first calibration step, the piston is pressed into the package until a force of 1N is recorded. The imprint level at which a force of 1 N is reached is considered to be imprint level 0. All other imprint levels indicate a distance from the imprint level 0.

The force is then to be continuously recorded as the piston is pressed into the package, Suitably, the piston may be pressed into the package until an imprint level of 10 mm is reached.

5 samples are produced and tested for each product, and a mean value is calculated.

As mentioned in the above, the packaging remains encircling the stack when performing the measurements. Accordingly, in many packages, the piston will contact the packaging when being pressed towards the stack end surface.

For packing materials currently used in the art, the presence of the packaging when performing the measurement will not significantly affect the results. At the pressures involved, the packaging will simply yield for the piston, and the results achieved will hence correctly reflect the properties of the stack encircled by the packaging.

Should any new packaging material of a kind that might significantly affect the results be used, it is suggested that a first measurement using the piston is made, wherein the piston is used to perform an initial impression into the package, the initial impression being a very short length into the package, e.g. 1 mm. The force required for performing this initial compression is recorded as an initial force. Thereafter, the packaging is removed from the stack, and the stack is arranged so as to be compressed by the piston as set out in the above-mentioned procedure. When the force required to press the piston into the stack is equal to the initial force, the initial impression length (e.g. 1 mm) is reached. Accordingly, the state of the stack when inside the package may be evaluated by using the initial impression length and corresponding initial force as calibration points for the impression curve.

It is preferred to test the packages within 6 months from their time of manufacture.

The package as described in the above may be varied within the scope of the appended claims. Materials in the stack and of the packaging materials may be varied as indicated in the above. Features from different alternatives and examples given in the description may be combined.

The invention claimed is:

1. A package comprising a stack of absorbent tissue paper material and a packaging, wherein, in said stack, the absorbent tissue paper material forms panels having a length, and a width perpendicular to said length, said panels being piled on top of each other to form a height extending between a first end surface and a second end surface of the stack;

the absorbent tissue paper material comprising at least a dry crepe material, the stack, when in said package, having a selected packing density D0 of 0.25 to 0.65 kg/dm$^3$, and exerting a force along the height of said stack towards the packaging, the packaging encircling said stack so as to maintain said stack in a compressed condition with said selected packing density D0 and exert a counter force to a springback force of the stack.

2. The package according to claim 1, wherein said absorbent tissue paper material is a combination material comprising at least one ply of a dry crepe material and one ply of another material.

3. The package according to claim 2, wherein the selected packing density D0 is 0.25 to 0.60 kg/dm$^3$.

4. The package according to claim 1, said packing density D0 being >0.20 and ≤0.35 kg/dm$^3$ and said package displaying a piston imprinting load as described herein at 3 mm imprint level IM3 being less than 130 N or said packing density D0 being >0.35 and ≤0.65 kg/dm$^3$ and said package displaying a piston imprinting load as described herein at 3 mm imprint level IM3 being less than 500 N.

5. The package according to claim 1, said packing density D0 being >0.20 and ≤0.35 kg/dm$^3$ and said package displaying a piston imprinting load as described herein at 6 mm imprint level IM6 being less than 500 N, or said packing density D0 being >0.35 and ≤0.65 kg/dm$^3$ and said package displaying a piston imprinting load IM6 as described herein at 6 mm imprint level being less than 8000 N.

6. The package according to claim 1, said packing density D0 being >0.20 and ≤0.35 kg/dm$^3$ and said package displaying a piston imprinting load as described herein at 3 mm imprint level IM3 and a piston imprinting load at 10 mm imprint level IM10, wherein IM10/IM3 is greater than 3; or said packing density D0 being >0.35 and ≤0.65 kg/dm$^3$ and said package displaying a piston imprinting load as described herein at 3 mm imprint level IM3 and a piston imprinting load at 10 mm imprint level IM10, wherein IM10/IM3 is greater than 4.5.

7. The package according to claim 1, said packing density D0 being >0.20 and ≤0.35 kg/dm$^3$ and said package displaying a piston imprinting load as described herein at 3 mm imprint level IM3 and a piston imprinting load at 6 mm imprint level IM6, wherein IM6/IM3 is greater than 1.5; or said packing density D0 being >0.35 and ≤0.65 kg/dm$^3$ and said package displaying a piston imprinting load as described herein at 3 mm imprint level IM3 and a piston imprinting load at 6 mm imprint level IM6, wherein IM6/IM3 is greater than 2.

8. The package according to claim 1, wherein said stack is a stack of folded absorbent tissue paper material.

9. The package according to claim 8, wherein said folded absorbent tissue paper material is a continuous web material.

10. The package according to claim 9, wherein the stack comprises at least one continuous web material being Z-folded.

11. The package according to claim 1, wherein said packaging is encircling said stack at least in a direction along a height direction of said stack.

12. The package according to claim 1, wherein said packaging is of a material having a tensile strength in a direction along the height of the stack being less than 10 kN/m$^2$.

13. The package according to claim 1, wherein said packaging is of a material having a tensile strength in a direction along the height of the stack being of at least 1.5 kN/m$^2$.

14. The package according to claim 1, wherein said packaging is made of a paper, non-woven or plastic material.

15. The package according to claim 1, wherein said packaging is closed to encircle said stack by means of a seal.

16. The package according to claim 15, wherein said seal is an adhesive seal.

17. The package according to claim 15, wherein said seal is an ultrasonic seal or a heatseal.

18. The package according to claim 2, wherein the selected packing density D0 is 0.25 to 0.55 kg/dm$^3$.

19. The package according to claim 2, wherein the selected packing density D0 is 0.30 to 0.55 kg/dm$^3$.

* * * * *